US006133227A

United States Patent [19]

Barnabas et al.

[11] Patent Number: 6,133,227

[45] Date of Patent: Oct. 17, 2000

[54] ENZYMATIC DETERGENT COMPOSITIONS

[75] Inventors: Mary Vijayarani Barnabas; Saroj Rai, both of West Chester; Ashoke Kumar Mitra, Mason; Andre Christian Convents, Cincinnati, all of Ohio

[73] Assignee: The Procter & Gamble Company, Cincinnati, Ohio

[21] Appl. No.: 09/445,929

[22] PCT Filed: Jun. 23, 1997

[86] PCT No.: PCT/US97/10972

§ 371 Date: Feb. 17, 2000

§ 102(e) Date: Feb. 17, 2000

[87] PCT Pub. No.: WO98/59228

PCT Pub. Date: Dec. 1, 1988

[51] Int. Cl.[7] ..... C11D 3/386

[52] U.S. Cl. ..... 510/530; 510/226; 510/235; 510/238; 510/283; 510/320; 510/321; 510/322; 510/362; 510/392; 510/393; 510/509; 510/515; 8/187; 134/25.2

[58] Field of Search ..... 510/226, 235, 510/283, 238, 320, 321, 322, 362, 392, 393, 509, 515, 530; 8/187; 134/25.2

[56] References Cited

U.S. PATENT DOCUMENTS

| | | | |
|---|---|---|---|
| 4,391,904 | 7/1983 | Litman et al. | 435/7 |
| 5,288,619 | 2/1994 | Brown et al. | 435/134 |
| 5,429,917 | 7/1995 | Mihayashi et al. | 430/544 |
| 5,854,202 | 8/1999 | Dedhar | 514/2 |
| 5,942,411 | 8/1999 | Kaasgaard et al. | 435/49 |

FOREIGN PATENT DOCUMENTS

| | | |
|---|---|---|
| 0342924 | 11/1989 | European Pat. Off. . |
| 2085937 | 5/1982 | United Kingdom . |
| 88/09367 | 5/1982 | WIPO . |

*Primary Examiner*—Kery Fries
*Attorney, Agent, or Firm*—C. Brant Cook; K. W. Zerby; J. C. Rasser

[57] ABSTRACT

The present invention relates to detergent compositions comprising an enzyme that increases the water-solubility of fatty acid-containing stains/soils, especially an acid-thiolligase, a desaturase enzyme and/or a glutathione S-transferase. These detergent compositions provide cleaning performance on body soils and/or oily/greasy soils and stains.

25 Claims, No Drawings

ENZYMATIC DETERGENT COMPOSITIONS

FIELD OF THE INVENTION

The present invention relates to detergent compositions, including laundry, dishwashing and household cleaning compositions comprising an enzyme that increases the water-solubility of saturated fatty acid-containing stains/soils.

BACKGROUND OF THE INVENTION

The overall performance of a detergent product for use in washing or cleaning method such as laundry, dishwashing, household cleaning, is judged by a number of factors, including the ability to remove body soils, greasy/oily soils and the ability to prevent redeposition of the soils or the breakdown products of the soils on the articles in the wash.

The complex nature of everyday "body" soils typically found on pillow cases, T-shirts, collars and socks, provides a thorough cleaning challenge for detergents. These soils are difficult to remove completely and often residues build up on fabric leading to dinginess and yellowing. Greasy/oily soils and stains represent also a well-known cleaning challenge often met by the inclusion of a lipolytic enzyme in the detergent compositions.

It is therefore an object of the present invention to provide detergent compositions, including laundry, dishwashing and household cleaning compositions, which provide cleaning performance on body soils and/or oily/greasy soils and stains.

The above objective has been met by formulating detergent compositions comprising an enzyme that increases the water-solubility of saturated fatty acid-containing stains/soils. These enzymes enhance the removal of such stains/soils by directly reacting with the saturated fatty acid components of the stains thereby increasing the water-solubility of said fatty acid component and resulting in an overall increase in stains/soils removal.

It has been further found that the overall performance of the detergent compositions of the present invention is optimised by the addition of another detergent enzyme, especially a lipolytic enzyme and/or a polymeric soil release agent.

According to the present invention, prefered enzymes that increase the water-solubility of saturated fatty acid-containing stains/soils are e.g. the acid-thiol ligase, desaturase and gluthathione S-transferase enzymes.

Acid-thiol ligases are commonly used in the determination of free fatty acids and of lipase activity (JP1020099; EP 273 647; U.S. Pat. No. 4,491,631; JP56158097; U.S. Pat. No. 4,360,591; JP60233560) and in pharmaceuticals products (U.S. Pat. No. 4,822,776). Desaturase enzymes are mainly described in transgenic plant production such as in the most recent WO96/21022, WO96/13591, U.S. Pat. No. 5,430,134, WO95/18222, WO94/18337, EP 644 263 as well as for the production of seed oil containing altered levels of saturated—unsaturated fatty acids such as in the most recent U.S. Pat. No. 5,443,974; WO94/10189; EP 561 569; WO91/18985; WO91/13972. The glutathion S-transferase enzyme is used in plant resistance to herbicide (WO97/11189 and DE 19 501 840) or in medical treatment and/or diagnostic such as in the most recent J09 0330521, J09 021 806, RU2 063 044, WO 96/40739, WO96/40205, J08 245 424, WO96/31779, J08 059 501, WO96/02674.

However, the use of an enzyme that increases the water-solubility of saturated fatty acid-containing stains/soils has never been previously suggested in detergent compositions, nor the benefits resulting therefrom when used in detergent compositions, have been recognised.

SUMMARY OF THE INVENTION

The present invention relates to detergent compositions, including laundry, dishwashing and household cleaning compositions, comprising an enzyme that increases the water-solubility of saturated fatty acid-containing stains/soils, thereby providing cleaning performance on body soils and/or oily/greasy soils and stains.

In another embodiment, the present invention relates to detergent compositions further comprising another detergent enzyme, especially a lipolytic enzyme and/or a polymeric soil release agent.

DETAILED DESCRIPTION OF THE INVENTION

Enzymes That Increase the Water-Solubility of Saturated Fatty Acid-Containing Stains/Soils An essential element of the detergent composition of the present invention is an enzyme that increases the water-solubility of saturated fatty acid-containing stains/soils.

By the term "an enzyme that increases the water-solubility of saturated fatty acid-containing stains/soils" it is meant any enzyme which acts directly on saturated fatty acids and achieves 20%, preferably 30%, more preferably 35% of fatty acid removal. The % of fatty acid removal is measured by the following method:

1. Soil cotton swatches with fatty acid stains being melted butter, palmitic and/or stearic fatty acid stains.
2. Pre-treatment/wash in Tris Buffer pH 7 with 0.05% pure enzyme by weight of total composition of the enzyme that increases the water-solubility of saturated fatty acid-containing stains/soils and with its corresponding essential cofactors. One pre-treament/wash with the enzyme system, another without the enzyme system.
3. Extraction of the fatty acid components from the soiled swatches: (i) Initial nil wash; (ii) Pre-treament/wash without the enzyme system; (iii) Pre-treament/wash with the enzyme system.
4. The Thin layer Chromatography (TLC) method is used to determine the quantitative level of lipids. The amounts of fatty acids are normalised versus (i) as 100% for the determination of % of fatty acid removal.

Steps 3 and 4 are described in the following lipid analysis:

Extraction Procedure

1). Cut fabric to fit in 16×100 size test tube. Weigh cut fabric. Weigh fabric in test tube.

2). On balance. Add −10 g. of pure hexanes, weigh to nearest 0.001 g.

3). Sonicate sample for 10 minutes. Record final temperature and weight of test tube.

4). Weigh new clean, dry test tube. Decant liquid from sonicated sample into new test tube. Record weight.

5). Evaporate liquid sample under nitrogen.

6). Weigh dried residue in tube. Calculate residue as a percentage of fabric sample.

7). Quantitatively analyse lipids in residue using TLC.

Quantitive Determination of Lipid Levels

TLC Plates: 20 cm×20 cm, Analtech Silica Gel-G (#56027)

Sample Application: 10 μl Clay Adams, Accu-Fill 90 Micropet Disposable Pipettes

Detection: Sulfuric Acid Charring

Evaluation: Camag Scanner II densitometer

Standard Preparation : Oleic and stearic acids were used for the free fatty acids. Tristearin and triolein were used for the triglycerides. A standard of cholesterol was added to the mixture. Cholesteryl stearate and cholesteryl oleate were used to quantitate the cholesteryl esters. Stearyl palmitate and oleyl oleate was used for the wax esters. A standard of squalene was also added to the mixture. Squalane (dodecahydrosqualene) was used in the standard mixture to quantitate the class of compounds referred to as "hydrocarbons".

Single-step TLC Development (Quantitative)

The TLC plates were developed to 17.5 cm with a solvent system of hexane:ethyl ether:acetic acid at 160 mL:40 mL:2 mL. This development solvent gave the best resolution for the more polar lipids such as fatty acids, mono-, di-, and triglycerides. The wax esters, cholesteryl esters, squalene, and hydrocarbons all co-migrated in this system.

Analytic Detection

The TLC plates were allowed to dry in a hood for 15 minutes after development. The plates were then sprayed with 7 mL of 25% $H_2SO_4$ and charred at 250° C. for 15–25 minutes. After charring, the TLC plates were evaluated with the Camag densitometer using absorbance in the transmission mode at 550 nm.

Analyte Quantitation

Quantitative analysis was accomplished by comparison of the area of each separate analyte with a calibration curve for the appropriate sebaceous lipid standards. The mass observed on the TLC plate was calculated from the calibration curve and then was converted to the units of $\mu$g/g of fabric. Unknown components on the TLC plate were quantitated from the calibration curve of the standard lipid with an $R_f$ closest to that of the unknown.

Examples of suitable enzymes are the acid thiol ligase, desaturase and/or glutathione S-transferase enzyme.

It has been found that this type of enzyme increases the water-solubility of unsaturated fatty acid-containing stains/soils and thereby facilitates their removal. The detergent compositions of the present invention formulated therewith, provide body soils and/or oily/greasy soils and stain removal. Combinations of several enzymes that increase the water-solubility of fatty acid containing stains/soils, especially the combination of the acid-thiol ligase and desaturase enzymes, result in improved body soil and/or oily/greasy soil and stain removal.

The enzyme that increases the water-solubility of saturated fatty acid-containing stains/soils, is incorporated into the compositions in accordance with the invention preferably at a level of from 0.0001% to 2%, more preferably from 0.005% to 0.5%, most preferably from 0.01% to 0.1% pure enzyme by weight of total composition.

Preferred enzymes that increase the water-solubility of saturated fatty acid-containing stains/soils for specific applications are alkaline enzymes, ie enzymes having an enzymatic activity of at least 10%, preferably at least 25%, more preferably at least 40% of its maximum activity at a pH ranging from 7 to 12. More preferred enzymes that increase the water-solubility of saturated fatty acid-containing stains/soils are enzymes having their maximum activity at a pH ranging from 7 to 12.

They may be of any suitable origin, such as vegetable, animal, bacterial, fungal and yeast origin. Origin can further be mesophilic or extremophilic (psychrophilic, psychrotrophic, thermophilic, barophilic, alkalophilic, acidophilic, halophilic, etc.). Purified or non-purified forms of these enzymes may be used. These enzymes can be produced by the so called wild-type organism or by any host organism in which the gene responsible for the production of these enzymes that increase the water-solubility of fatty acid-containing stains/soils, has been cloned and expressed.

Nowadays, it is common practice to modify wild-type enzymes via protein/genetic engineering techniques in order to optimise their performance efficiency in the detergent compositions of the invention. For example, the variants may be designed such that the compatibility of the enzyme to commonly encountered ingredients of such compositions is increased. Alternatively, the variant may be designed such that the optimal pH, bleach stability, catalytic activity and the like, of the enzyme variant is tailored to suit the particular cleaning application.

In particular, attention should be focused on amino acids sensitive to oxidation in the case of bleach stability and on surface charges for the surfactant compatibility. The isoelectric point of such enzymes may be modified by the substitution of some charged amino acids, e.g. an increase in isoelectric point may help to improve compatibility with anionic surfactants. The stability of the enzymes may be further enhanced by the creation of e.g. additional salt bridges and enforcing calcium binding sites to increase chelant stability.

Acid Thiol Ligase Enzyme

Suitable acid-thiol ligases for the purpose of the present invention are described under EC 6.2.1. Preferred acid-thiol ligases are:

EC 6.2.1.3 Long-chain-fatty-acid-CoA ligase, also referred to as Acyl-CoA synthetase;

EC 6.2.1.10 Acid-CoA ligase, also referred to as Acyl-CoA synthetase;

EC 6.2.1.20 Long-chain-fatty-acid-ACP ligase, also referred to as Acyl-ACP synthetase.

Fatty Acid Acyl CoA Synthetase and Fatty Acid Acyl ACP Synthetase are commercially available acid-thiol ligases, sold by Sigma or Boehringer Mannheim. JP656064787 describes an acyl CoA synthetase preparation by cultivating Candida arborga strain; DE2917891 discloses a microbiological production of acyl CoA synthetase.

The acid-thiol ligase enzyme requires an esterification compound being a strong nucleophile and a source of energy being molecules having a free energy of hydrolysis greater or equal to 11 Kcal/mol. Examples of esterification compounds are Coenzyme A (CoA), Acyl Carrier protein (ACP), gluthathione (a tripeptide of cysteine, glutamic acidand glycine) or a polyamine such as N-(aminoethyl)ethyl amine ($NH_2$—$CH_2CH_2$—NH—$CH_2CH_3$) and are available from Boehringer Mannheim or Sigma. They are generally comprised in the detergent compositions of the present invention at a level of from 0.01% to 10%, preferably from 0.1% to 5% by weight of total composition. Examples of such energy sources are Adenosine 5'-triphosphate (ATP), phosphoenolpyruvic acid, creatine phosphate, acetyl phosphate and are available from Boehringer Mannheim, Sigma or Aldrian. They are generally comprised in the detergent composition of the present invention at a level of from 0.01% to 10%, preferably from 0.1% to 5% by weight of total composition.

It has been established that one of the major components of the body soils, greasy and/or oily soil/stain are fatty acids. Without wishing to be bound by theory, it is believed that the acid-thiol ligase enzymes derivatise/esterify the fatty acids, rendering them more water soluble and thereby improve the cleaning of the washed surface.

Desaturase Enzyme

Suitable desaturases for the purpose of the present invention are the EC 1.14.99.5 Stearoyl-CoA desaturase and EC 1.14.99.6 Acyl-ACP desaturase.

Fatty acid ACP desaturase is a commercially available desaturase enzyme, sold by Dupont.

The desaturase enzyme requires an electron donor system, being a reducing agent which donates an electron to convert $Fe^{3+}$ to $Fe^{2+}$, corresponding to a redox potential above 0.771V. Examples of electron donor systems are ferrodoxin, Nicotinamide adenine dinucleotide phosphate reduced form (NADPH) and ferredoxin:NADPH(+) oxidoreductase wherein the NADPH can potentially be replaced by an effective reducing system composed of ferredoxin, grana (Spinach chloroplast) lamellae, ascorbic acid, dichlorophenolindophenol and light/dithiothreitol and reduced glutathione/dithionite or ascorbate such as described in Arcxh. Biochem. Biophys. 162, p158 (1974) and J. Biol. Chem. 243, p4626 (1968) and are available from Boehringer Mannheim or Sigma. They are generally comprised in the detergent composition of the present invention at a level of from 0.001% to 10%, preferably from 0.01% to 5% by weight of total composition.

Without wishing to be bound by theory, it is believed that the higher the unsaturation of fatty acids chains, the easier is their cleaning/removal. The desaturase enzyme is believed to introduce unsaturation in the fatty acids contained in the stains/soils and thereby facilitate their removal.

When the detergent compositions of the present invention comprise both the acid-thiol ligase and desaturase enzymes, these enzymes are preferably included in a weight ratio of pure enzyme of acid-thiol ligase to desaturase between 1:10 and 10:1, the most preferred weight ratio being 1:1.

Glutathione S-transferase

Glutathione S-transferase enzymes are a group of cytosolic enzymes that catalyse the conjugation of the natural nucleophile tripeptide glutathione to reactive electrophiles generated in the cell. These enzymes are also believed to act as carriers of fatty acids in the cell, both saturated such as palmitic and stearic acids and unsaturated such as linoleic and arachidonic acids. Without wishing to be bound by theory, it is believed that the lipid binding properties of glutathione S-transferase enzymes in absence of its natural cofactor glutathione are useful in removing fatty acids stains from the fabrics.

Suitable glutathione S-transferase for the purpose of the present invention are described under EC 2.5.1.18. G6636 and G8642 are commercially available glutathione S-transferases, sold by Sigma.

Detergent Components

The detergent compositions of the invention may also contain additional detergent components. The precise nature of these additional components, and levels of incorporation thereof will depend on the physical form of the composition, and the nature of the cleaning operation for which it is to be used.

Preferred additional ingredients to be used in the detergent compositions of the present invention, are enzymes, especially lipolytic enzymes, and/or polymeric soil release polymers.

In a preferred embodiment, the present invention relates to laundry and/or fabric care compositions comprising an enzyme that increases the water-solubility of fatty acid-containing stains/soils (Examples 1–18). In a second embodiment, the present invention relates to dishwashing or household cleaning compositions (Examples 19–26).

The detergent compositions according to the invention can be liquid, paste, gels, bars, tablets, powder or granular forms. Granular compositions can also be in "compact" form, the liquid compositions can also be in a "concentrated" form.

The compositions of the invention may for example, be formulated as hand and machine dishwashing compositions, hand and machine laundry detergent compositions including laundry additive compositions and compositions suitable for use in the soaking and/or pretreatment of stained fabrics, rinse added fabric softener compositions, and compositions for use in general household hard surface cleaning operations.

When formulated as compositions for use in manual dishwashing methods the compositions of the invention preferably contain a surfactant and preferably other detergent compounds selected from organic polymeric compounds, suds enhancing agents, group II metal ions, solvents, hydrotropes and additional enzymes.

When formulated as compositions suitable for use in a laundry machine washing method, the compositions of the invention preferably contain both a surfactant and a builder compound and additionally one or more detergent components preferably selected from organic polymeric compounds, bleaching agents, additional enzymes, suds suppressors, dispersants, lime-soap dispersants, soil suspension and anti-redeposition agents and corrosion inhibitors. Laundry compositions can also contain softening agents, as additional detergent components.

Such compositions containing an enzyme that increases the water-solubility of fatty acid-containing stains/soils can provide fabric cleaning, stain removal, whiteness maintenance, softening, color appearance and dye transfer inhibition when formulated as laundry detergent compositions.

The compositions of the invention can also be used as detergent additive products. Such additive products are intended to supplement or boost the performance of conventional detergent compositions.

If needed the density of the laundry detergent compositions herein ranges from 400 to 1200 g/liter, preferably 600 to 950 g/liter of composition measured at 20° C.

The "compact" form of the compositions herein is best reflected by density and, in terms of composition, by the amount of inorganic filler salt; inorganic filler salts are conventional ingredients of detergent compositions in powder form; in conventional detergent compositions, the filler salts are present in substantial amounts, typically 17–35% by weight of the total composition.

In the compact compositions, the filler salt is present in amounts not exceeding 15% of the total composition, preferably not exceeding 10%, most preferably not exceeding 5% by weight of the composition.

The inorganic filler salts, such as meant in the present compositions are selected from the alkali and alkaline-earth-metal salts of sulphates and chlorides.

A preferred filler salt is sodium sulphate.

Liquid detergent compositions according to the present invention can also be in a "concentrated form", in such case, the liquid detergent compositions according the present invention will contain a lower amount of water, compared to conventional liquid detergents.

Typically the water content of the concentrated liquid detergent is preferably less than 40%, more preferably less than 30%, most preferably less than 20% by weight of the detergent composition.

Conventional Detergent Enzymes

The detergent compositions can further comprise one or more enzymes which provide cleaning performance and/or fabric care benefits in addition to an enzyme that increases the water-solubility of saturated fatty acid-containing stains/soils. Indeed, it has been found that the detergent compositions of the present invention further comprising another detergent enzyme, especially a lipase, provide improved cleaning performance on body soils and/or oily/greasy soils and stains.

Said enzymes include enzymes selected from cellulases, hemicellulases, peroxidases, proteases, gluco-amylases, amylases, xylanases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, laccase or mixtures thereof.

A preferred combination is a detergent composition having cocktail of conventional applicable enzymes like protease, amylase, lipase, cutinase and/or cellulase in conjunction with one or more plant cell wall degrading enzymes.

Suitable lipase enzymes for detergent usage include those produced by microorganisms of the Pseudomonas group, such as Pseudomonas stutzeri ATCC 19.154, as disclosed in British Patent 1,372,034. Suitable lipases include those which show a positive immunological cross-reaction with the antibody of the lipase, produced by the microorganism *Pseudomonas fluorescent* IAM 1057. This lipase is available from Amano Pharmaceutical Co. Ltd., Nagoya, Japan, under the trade name Lipase P "Amano," hereinafter referred to as "Amano-P". Other suitable commercial lipases include Amano-CES, lipases ex *Chromobacter viscosum,* e.g. *Chromobacter viscosum* var. *lipolyticum* NRRLB 3673 from Toyo Jozo Co., Tagata, Japan; *Chromobacter viscosum* lipases from U.S. Biochemical Corp., U.S.A. and Disoynth Co., The Netherlands, and lipases ex *Pseudomonas gladioli.* Especially suitable lipases are lipases such as M1 Lipase$^R$ and Lipomax$^R$ (Gist-Brocades) and Lipolase$^R$ and Lipolase Ultra$^R$ (Novo) which have found to be very effective when used in combination with the compositions of the present invention. Also suitables are the lipolytic enzymes described in EP 258 068, WO 92/05249 and WO 95/22615 by Novo Nordisk and in WO 94/03578, WO 95/35381 and WO 96/00292 by Unilever. Also suitable are cutinases [EC 3.1.1.50] which can be considered as a special kind of lipase, namely lipases which do not require interfacial activation. Addition of cutinases to detergent compositions have been described in e.g. WO-A-88/09367 (Genencor); WO 90/09446 (Plant Genetic System) and WO 94/14963 and WO 94/14964 (Unilever). The lipases and/or cutinases are normally incorporated in the detergent composition at levels from 0.0001% to 2% of pure enzyme by weight of the detergent composition.

The cellulases usable in the present invention include both bacterial or fungal cellulase. Preferably, they will have a pH optimum of between 5 and 9.5. Suitable cellulases are disclosed in U.S. Pat. No. 4,435,307, Barbesgoard et al, which discloses fungal cellulase produced from Humicola insolens. Suitable cellulases are also disclosed in GB-A-2.075.028; GB-A-2.095.275 and DE-OS-2.247.832.

Examples of such cellulases are cellulases produced by a strain of *Humicola insolens* (*Humicola grisea* var. *thermoidea*), particularly the Humicola strain DSM 1800. Other suitable cellulases are cellulases originated from *Humicola insolens* having a molecular weight of about 50 KDa, an isoelectric point of 5.5 and containing 415 amino acids; and a ~43 kD endoglucanase derived from *Humicola insolens,* DSM 1800, exhibiting cellulase activity; a preferred endoglucanase component has the amino acid sequence disclosed in PCT Patent Application No. WO 91/17243. Also suitable cellulases are the EGIII cellulases from *Trichoderma longibrachiatum* described in WO9421801, Genencor, published Sep. 29, 1994. Especially suitable cellulases are the cellulases having color care benefits. Examples of such cellulases are cellulases described in European patent application No. 91202879.2, filed Nov. 6, 1991 (Novo). Carezyme and Celluzyme (Novo Nordisk A/S) are especially useful. See also WO91/17244 and WO91/21801.

Peroxidase enzymes are used in combination with oxygen sources, e.g. percarbonate, perborate, persulfate, hydrogen peroxide, etc. They are used for "solution bleaching", i.e. to prevent transfer of dyes or pigments removed from substrates during wash operations to other substrates in the wash solution. Peroxidase enzymes are known in the art, and include, for example, horseradish peroxidase, ligninase and haloperoxidase such as chloro- and bromo-peroxidase. Peroxidase-containing detergent compositions are disclosed, for example, in PCT International Application WO 89/099813, WO89/09813 and in European Patent application EP No. 91202882.6, filed on Nov. 6, 1991 and EP No. 96870013.8, filed Feb. 20, 1996. Also suitable is the laccase enzyme.

Preferred enhancers are substitued phenthiazine and phenoxasine 10-Phenothiazinepropionicacid (PPT), 10-ethylphenothiazine4-carboxylic acid (EPC), 10-phenoxazinepropionic acid (POP) and 10-methylphenoxazine (described in WO 94/12621) and substitued syringates (C3–C5 substitued alkyl syringates) and phenols. Sodium percarbonate or perborate are preferred sources of hydrogen peroxide.

Said cellulases and/or peroxidases are normally incorporated in the detergent composition at levels from 0.0001% to 2% of pure enzyme by weight of the detergent composition.

Suitable proteases are the subtilisins which are obtained from particular strains of *B. subtilis* and *B. licheniformis* (subtilisin BPN and BPN'). One suitable protease is obtained from a strain of Bacillus, having maximum activity throughout the pH range of 8–12, developed and sold as ESPERASE® by Novo Industries A/S of Denmark, hereinafter "Novo". The preparation of this enzyme and analogous enzymes is described in GB 1,243,784 to Novo. Other suitable proteases include ALCALASE®, DURAZYM® and SAVINASE® from Novo and MAXATASE®, MAXACAL®, PROPERASE® and MAXAPEM® (protein engineered Maxacal) from Gist-Brocades. Proteolytic enzymes also encompass modified bacterial serine proteases, such as those described in European Patent Application Serial Number 87 303761.8, filed Apr. 28, 1987 (particularly pages 17, 24 and 98), and which is called herein "Protease B", and in European Patent Application 199,404, Venegas, published Oct. 29, 1986, which refers to a modified bacterial serine protealytic enzyme which is called "Protease A" herein. Suitable is what is called herein "Protease C", which is a variant of an alkaline serine protease from Bacillus in which lysine replaced arginine at position 27, tyrosine replaced valine at position 104, serine replaced asparagine at position 123, and alanine replaced threonine at position 274. Protease C is described in EP 90915958:4, corresponding to WO 91/06637, Published May 16, 1991. Genetically modified variants, particularly of Protease C, are also included herein. A preferred protease referred to as "Protease D" is a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position +76, preferably also in combination with one or more amino acid residue positions equivalent to those selected from the group consisting of +99, +101, +103, +104, +107, +123, +27, +105, +109, +126, +128, +135, +156, +166, +195, +197, +204, +206, +210, +216, +217, +218, +222, +260, +265, and/or +274 according to the numbering of *Bacillus amyloliquefaciens subtilisin,* as described in WO95/10591 and in the patent application of C. Ghosh, et al, "Bleaching Compositions Comprising Protease Enzymes" having U.S. Ser. No. 08/322,677, filed Oct. 13, 1994. Also suitable for the present invention are proteases described in patent applications EP 251 446 and WO 91/06637, protease BLAP® described in WO91/02792 and their variants described in WO 95/23221. See also a high pH protease from Bacillus sp. NCIMB 40338 described in WO 93/18140 A to Novo. Enzymatic detergents comprising protease, one or more other enzymes, and a reversible protease inhibitor are described in WO 92/03529 A to Novo. When desired, a protease having decreased adsorption and increased hydrolysis is available as described in WO 95/07791 to Procter & Gamble. A recombinant trypsin-like protease for detergents suitable herein is described in WO 94/25583 to Novo. Other suitable proteases are described in EP 516 200 by Unilever.

The proteolytic enzymes are incorporated in the detergent compositions of the present invention a level of from 0.0001% to 2%, preferably from 0.001% to 0.2%, more preferably from 0.005% to 0.1% pure enzyme by weight of the composition.

Amylases (α and/or β) can be included for removal of carbohydrate-based stains. WO94/02597, Novo Nordisk A/S published Feb. 03, 1994, describes cleaning compositions which incorporate mutant amylases. See also WO95/10603, Novo Nordisk A/S, published Apr. 20, 1995. Other amylases known for use in cleaning compositions include both α- and β-amylases. α-Amylases are known in the art and include those disclosed in U.S. Pat. No. 5,003,257; EP 252,666; WO/91/00353; FR 2,676,456; EP 285,123; EP 525,610; EP 368,341; and British Patent specification no. 1,296,839 (Novo). Other suitable amylases are stability-enhanced amylases described in WO94/18314, published Aug. 18, 1994 and WO96/05295, Genencor, published Feb. 22, 1996 and amylase variants having additional modification in the immediate parent available from Novo Nordisk ANS, disclosed in WO 95/10603, published April 95. Also suitable are amylases described in EP 277 216, WO95/26397 and WO96/23873 (all by Novo Nordisk). Examples of commercial α-amylases products are Purafect Ox Am® from Genencor and Termamyl®, Ban®, Fungamyl® and Duramyl®, all available from Novo Nordisk A/S Denmark. WO95/26397 describes other suitable amylases: α-amylases characterised by having a specific activity at least 25% higher than the specific activity of Termamyl® at a temperature range of 25° C. to 55° C. and at a pH value in the range of 8 to 10, measured by the Phadebas® α-amylase activity assay. Suitable are variants of the above enzymes, described in WO96/23873 (Novo Nordisk). Other amylolytic enzymes with improved properties with respect to the activity level and the combination of thermostability and a higher activity level are described in WO95/35382.

The amylolytic enzymes are incorporated in the detergent compositions of the present invention a level of from 0.0001% to 2%, preferably from 0.00018% to 0.06%, more preferably from 0.00024% to 0.048% pure enzyme by weight of the composition.

The above-mentioned enzymes may be of any suitable origin, such as vegetable, animal, bacterial, fungal and yeast origin. Origin can further be mesophilic or extremophilic (psychrophilic, psychrotrophic, thermophilic, barophilic, alkalophilic, acidophilic, halophilic, etc.). Purified or non-purified forms of these enzymes may be used. Also included by definition, are mutants of native enzymes. Mutants can be obtained e.g. by protein and/or genetic engineering, chemical and/or physical modifications of native enzymes. Common practice as well is the expression of the enzyme via host organisms in which the genetic material responsible for the production of the enzyme has been cloned.

Said enzymes are normally incorporated in the detergent composition at levels from 0.0001% to 2% of pure enzyme by weight of the detergent composition. The enzymes can be added as separate single ingredients (prills, granulates, stabilized liquids, etc. containing one enzyme) or as mixtures of two or more enzymes (e.g. cogranulates).

Other suitable detergent ingredients that can be added are enzyme oxidation scavengers which are described in Copending European Patent application 92870018.6 filed on Jan. 31, 1992. Examples of such enzyme oxidation scavengers are ethoxylated tetraethylene polyamines.

A range of enzyme materials and means for their incorporation into synthetic detergent compositions is also disclosed in WO 9307263 A and WO 9307260 A to Genencor International, WO 8908694 A to Novo, and U.S. Pat. No. 3,553,139, Jan. 5, 1971 to McCarty et al. Enzymes are further disclosed in U.S. Pat. No. 4,101,457, Place et al, Jul. 18, 1978, and in U.S. Pat. No. 4,507,219, Hughes, Mar. 26, 1985. Enzyme materials useful for liquid detergent formulations, and their incorporation into such formulations, are disclosed in U.S. Pat. No. 4,261,868, Hora et al, Apr. 14, 1981. Enzymes for use in detergents can be stabilised by various techniques. Enzyme stabilisation techniques are disclosed and exemplified in U.S. Pat. No. 3,600,319, Aug. 17, 1971, Gedge et al, EP 199,405 and EP 200,586, Oct. 29, 1986, Venegas. Enzyme stabilisation systems are also described, for example, in U.S. Pat. No. 3,519,570. A useful Bacillus, sp. AC13 giving proteases, xylanases and cellulases, is described in WO 9401532 A to Novo.

Polymeric Soil Release Agent

The detergent compositions can further comprise a polymeric soil release agent in addition to an enzyme that increases the water-solubility of fatty acid-containing stains/soils. Indeed, it has been found that the detergent compositions of the present invention further comprising a polymeric soil release agent, provide improved cleaning performance on body soils and/or oily/greasy soils and stains.

Known polymeric soil release agents, hereinafter "SRA", are preferably employed in the present detergent compositions. SRA's will generally comprise from 0.01% to 10.0%, typically from 0.1% to 5%, preferably from 0.2% to 3.0% by weight, of the compositions.

Preferred SRA's typically have hydrophilic segments to hydrophilize the surface of hydrophobic fibers such as polyester and nylon, and hydrophobic segments to deposit upon hydrophobic fibers and remain adhered thereto through completion of washing and rinsing cycles, thereby serving as an anchor for the hydrophilic segments. This can enable stains occurring subsequent to treatment with the SRA to be more easily cleaned in later washing procedures.

SRA's can include a variety of charged, e.g., anionic or even cationic species, see U.S. Pat. No. 4,956,447, issued Sep. 11, 1990 to Gosselink, et al., as well as noncharged monomer units, and their structures may be linear, branched or even star-shaped. They may include capping moieties which are especially effective in controlling molecular weight or altering the physical or surface-active properties. Structures and charge distributions may be tailored for application to different fiber or textile types and for varied detergent or detergent additive products.

Preferred SRA's include oligomeric terephthalate esters, typically prepared by processes involving at least one transesterification/oligomerization, often with a metal catalyst such as a titanium(IV) alkoxide. Such esters may be made using additional monomers capable of being incorporated into the ester structure through one, two, three, four or more positions, without, of course, forming a densely crosslinked overall structure.

Suitable SRA's include a sulfonated product of a substantially linear ester oligomer comprised of an oligomeric ester backbone of terephthaloyl and oxyalkyleneoxy repeat units and allyl-derived sulfonated terminal moieties covalently attached to the backbone, for example as described in U.S. Pat. No. 4,968,451, Nov. 6, 1990 to J. J. Scheibel and E. P. Gosselink. Such ester oligomers can be prepared by: (a) ethoxylating allyl alcohol; (b) reacting the product of (a) with dimethyl terephthalate ("DMT") and 1,2-propylene glycol ("PG") in a two-stage transesterification/oligomerization procedure; and (c) reacting the product of (b) with sodium metabisulfite in water. Other SRA's include the nonionic end-capped 1,2-propylene/polyoxyethylene terephthalate polyesters of U.S. Pat. No. 4,711,730, Dec. 8, 1987 to Gosselink et al., for example those produced by transesterification/oligomerization of poly(ethyleneglycol) methyl ether, DMT, PG and poly(ethyleneglycol) ("PEG"). Other examples of SRA's include: the partly- and fully- anionic-end-capped oligomeric esters of U.S. Pat. No. 4,721,580, Jan. 26, 1988 to Gosselink, such as oligomers from ethylene glycol ("EG"), PG, DMT and Na-3,6-dioxa-8-hydroxyoctanesulfonate; the nonionic-capped block polyester oligomeric compounds of U.S. Pat. No. 4,702,857, Oct. 27, 1987 to Gosselink, for example produced from DMT, methyl (Me)-capped PEG and EG and/or PG, or a combination of DMT, EG and/or PG, Me-capped PEG and Na-dimethyl-5-sulfoisophthalate; and the anionic, especially sulfoaroyl, end-capped terephthalate esters of U.S. Pat. No. 4,877,896, Oct. 31, 1989 to Maldonado, Gosselink et al., the latter being typical of SRA's useful in both laundry and fabric conditioning products, an example being an ester composition made from m-sulfobenzoic acid monosodium salt, PG and DMT, optionally but preferably further comprising added PEG, e.g., PEG 3400.

SRA's also include: simple copolymeric blocks of ethylene terephthalate or propylene terephthalate with polyethylene oxide or polypropylene oxide terephthalate, see U.S. Pat. No. 3,959,230 to Hays, May 25, 1976 and U.S. Pat. No. 3,893,929 to Basadur, Jul. 8, 1975; cellulosic derivatives such as the hydroxyether cellulosic polymers available as METHOCEL from Dow; the $C_1$–$C_4$ alkyl celluloses and $C_4$ hydroxyalkyl celluloses, see U.S. Pat. No. 4,000,093, Dec. 28, 1976 to Nicol, et al.; and the methyl cellulose ethers having an average degree of substitution (methyl) per anhydroglucose unit from about 1.6 to about 2.3 and a solution viscosity of from about 80 to about 120 centipoise measured at 20° C. as a 2% aqueous solution. Such materials are available as METOLOSE SM100 and METOLOSE SM200, which are the trade names of methyl cellulose ethers manufactured by Shin-etsu Kagaku Kogyo KK.

Suitable SRA's characterised by poly(vinyl ester) hydrophobe segments include graft copolymers of poly(vinyl ester), e.g., $C_1$–$C_6$ vinyl esters, preferably poly(vinyl acetate), grafted onto polyalkylene oxide backbones. See European Patent Application 0 219 048, published Apr. 22, 1987 by Kud, et al. Commercially available examples include SOKALAN SEA's such as SOKALAN HP-22, available from BASF, Germany. Other SRA's are polyesters with repeat units containing 10–15% by weight of ethylene terephthalate together with 80–90% by weight of polyoxyethylene terephthalate derived from a polyoxyethylene glycol of average molecular weight 300–5,000. Commercial examples include ZELCON 5126 from Dupont and MILEASE T from ICI.

Another preferred SRA is an oligomer having empirical formula $(CAP)_2(EG/PG)_5(T)_5(SIP)_1$ which comprises terephthaloyl (T), sulfoisophthaloyl (SIP), oxyethyleneoxy and oxy-1,2-propylene (EG/PG) units and which is preferably terminated with end-caps (CAP), preferably modified isethionates, as in an oligomer comprising one sulfoisophthaloyl unit, 5 terephthaloyl units, oxyethyleneoxy and oxy-1,2-propyleneoxy units in a defined ratio, preferably about 0.5:1 to about 10:1, and two end-cap units derived from sodium 2-(2-hydroxyethoxy)-ethanesulfonate. Said SRA preferably further comprises from 0.5% to 20%, by weight of the oligomer, of a crystallinity-reducing stabiliser, for example an anionic surfactant such as linear sodium dodecylbenzenesulfonate or a member selected from xylene-, cumene-, and toluene-sulfonates or mixtures thereof, these stabilizers or modifiers being introduced into the synthesis vessel, all as taught in U.S. Pat. No. 5,415,807, Gosselink, Pan, Kellett and Hall, issued May 16, 1995. Suitable monomers for the above SRA include Na-2-(2-hydroxyethoxy)-ethanesulfonate, DMT, Na-dimethyl-5-sulfoisophthalate, EG and PG.

Yet another group of preferred SRA's are oligomeric esters comprising: (1) a backbone comprising (a) at least one unit selected from the group consisting of dihydroxysulfonates, polyhydroxy sulfonates, a unit which is at least trifunctional whereby ester linkages are formed resulting in a branched oligomer backbone, and combinations thereof; (b) at least one unit which is a terephthaloyl moiety; and (c) at least one unsulfonated unit which is a 1,2-oxyalkyleneoxy moiety; and (2) one or more capping units selected from nonionic capping units, anionic capping units such as alkoxylated, preferably ethoxylated, isethionates, alkoxylated propanesulfonates, alkoxylated propanedisulfonates, alkoxylated phenolsulfonates, sulfoaroyl derivatives and mixtures thereof. Preferred are esters of the empirical formula:

$$\{(CAP)x(EG/PG)y'(DEG)y''(PEG)y'''(T)z(SIP)z'(SEG)q(B)m\}$$

wherein CAP, EG/PG, PEG, T and SIP are as defined hereinabove, (DEG) represents di(oxyethylene)oxy units, (SEG) represents units derived from the sulfoethyl ether of glycerin and related moiety units, (B) represents branching units which are at least trifunctional whereby ester linkages are formed resulting in a branched oligomer backbone, x is from about 1 to about 12, y' is from about 0.5 to about 25, y" is from 0 to about 12, y''' is from 0 to about 10, y'+y"+y''' totals from about 0.5 to about 25, z is from about 1.5 to about 25, z' is from 0 to about 12; z+z' totals from about 1.5 to about 25, q is from about 0.05 to about 12; m is from about 0.01 to about 10, and x, y', y", y''', z, z', q and m represent the average number of moles of the corresponding units per mole of said ester and said ester has a molecular weight ranging from about 500 to about 5,000.

Preferred SEG and CAP monomers for the above esters include Na-2-(2-,3-dihydroxypropoxy)ethanesulfonate ("SEG"), Na-2-{2-(2-hydroxyethoxy)ethoxy}ethanesulfonate ("SE3") and its homologs and mixtures thereof and the products of ethoxylating and sulfonating allyl alcohol. Preferred SRA esters in this class include the product of transesterifying and oligomerizing sodium 2-{2-(2-hydroxyethoxy)ethoxy}ethanesulfonate and/or sodium 2-[2-{2-(2-hydroxyethoxy)ethoxy}-ethoxy] ethanesulfonate, DMT, sodium 2-(2,3-dihydroxypropoxy) ethane sulfonate, EG, and PG using an appropriate Ti(IV) catalyst and can be designated as (CAP)2(T)5(EG/PG)1.4 (SEG)2.5(B)0.13 wherein CAP is (Na+-$O_3S[CH_2CH_2O]$ 3.5)- and B is a unit from glycerin and the mole ratio EG/PG is about 1.7:1 as measured by conventional gas chromatography after complete hydrolysis.

Additional classes of SRA's include: (I) nonionic terephthalates using diisocyanate coupling agents to link polymeric ester structures, see U.S. Pat. No. 4,201,824, Violland et al. and U.S. Pat. No. 4,240,918 Lagasse et al.; and (II) SRA's with carboxylate terminal groups made by adding trimellitic anhydride to known SRA's to convert terminal hydroxyl groups to trimellitate esters. With the proper selection of catalyst, the trimellitic anhydride forms linkages to the terminals of the polymer through an ester of the isolated carboxylic acid of trimellitic anhydride rather than by opening of the anhydride linkage. Either nonionic or anionic SRA's may be used as starting materials as long as they have hydroxyl terminal groups which may be esterified. See U.S. Pat. No. 4,525,524 Tung et al. Other classes include: (III) anionic terephthalate-based SRA's of the urethane-linked variety, see U.S. Pat. No. 4,201,824, Violland et al.; (IV) poly(vinyl caprolactam) and related co-polymers with monomers such as vinyl pyrrolidone and/or dimethylaminoethyl methacrylate, including both nonionic and cationic polymers, see U.S. Pat. No. 4,579,681, Ruppert et al.; (V) graft copolymers, in addition to the SOKALAN types from BASF, made by grafting acrylic monomers onto sulfonated polyesters. These SRA's assertedly have soil release and anti-redeposition activity similar to known cellulose ethers: see EP 279,134 A, 1988, to Rhone-Poulenc Chemie. Still other classes include: (VI) grafts of vinyl monomers such as acrylic acid and vinyl acetate onto proteins such as caseins, see EP 457,205 A to BASF (1991); and (VII) polyester-polyamide SRA's prepared by condensing adipic acid, caprolactam, and polyethylene glycol, especially for treating polyamide fabrics, see Bevan et al., DE 2,335,044 to Unilever N. V., 1974. Other useful SRA's are described in U.S. Pat. Nos. 4,240,918, 4,787,989 and 4,525,524.

Surfactant System

The detergent compositions according to the present invention generally comprise a surfactant system wherein the surfactant can be selected from nonionic and/or anionic and/or cationic and/or ampholytic and/or zwitterionic and/or semi-polar surfactants.

The surfactant is typically present at a level of from 0.1% to 60% by weight. More preferred levels of incorporation are 1% to 35% by weight, most preferably from 1% to 30% by weight of detergent compositions in accord with the invention.

The surfactant is preferably formulated to be compatible with enzyme components present in the composition. In liquid or gel compositions the surfactant is most preferably formulated such that it promotes, or at least does not degrade, the stability of any enzyme in these compositions.

Preferred surfactant systems to be used according to the present invention comprise as a surfactant one or more of the nonionic and/or anionic surfactants described herein.

Polyethylene, polypropylene, and polybutylene oxide condensates of alkyl phenols are suitable for use as the nonionic surfactant of the surfactant systems of the present invention, with the polyethylene oxide condensates being preferred. These compounds include the condensation products of alkyl phenols having an alkyl group containing from about 6 to about 14 carbon atoms, preferably from about 8 to about 14 carbon atoms, in either a straight-chain or branched-chain configuration with the alkylene oxide. In a preferred embodiment, the ethylene oxide is present in an amount equal to from about 2 to about 25 moles, more preferably from about 3 to about 15 moles, of ethylene oxide per mole of alkyl phenol. Commercially available nonionic surfactants of this type include Igepal™ CO-630, marketed by the GAF Corporation; and Triton™ X-45, X-114, X-100 and X-102, all marketed by the Rohm & Haas Company. These surfactants are commonly referred to as alkylphenol alkoxylates (e.g., alkyl phenol ethoxylates).

The condensation products of primary and secondary aliphatic alcohols with from about 1 to about 25 moles of ethylene oxide are suitable for use as the nonionic surfactant of the nonionic surfactant systems of the present invention. The alkyl chain of the aliphatic alcohol can either be straight or branched, primary or secondary, and generally contains from about 8 to about 22 carbon atoms. Preferred are the condensation products of alcohols having an alkyl group containing from about 8 to about 20 carbon atoms, more preferably from about 10 to about 18 carbon atoms, with from about 2 to about 10 moles of ethylene oxide per mole of alcohol. About 2 to about 7 moles of ethylene oxide and most preferably from 2 to 5 moles of ethylene oxide per mole of alcohol are present in said condensation products. Examples of commercially available nonionic surfactants of this type include Tergitol™ 15-S-9 (the condensation product of $C_{11}$–$C_{15}$ linear alcohol with 9 moles ethylene oxide), Tergitol™ 24-L-6 NMW (the condensation product of $C_{12}$–$C_{14}$ primary alcohol with 6 moles ethylene oxide with a narrow molecular weight distribution), both marketed by Union Carbide Corporation; Neodol™ 45-9 (the condensation product of $C_{14}$–$C_{15}$ linear alcohol with 9 moles of ethylene oxide), Neodol™ 23-3 (the condensation product of $C_{12}$–$C_{13}$ linear alcohol with 3.0 moles of ethylene oxide), Neodol™ 45-7 (the condensation product of $C_{14}$–$C_{15}$ linear alcohol with 7 moles of ethylene oxide), Neodol™ 45-5 (the condensation product of $C_{14}$–$C_{15}$ linear alcohol with 5 moles of ethylene oxide) marketed by Shell Chemical Company, Kyro™ EOB (the condensation product of $C_{13}$–$C_{15}$ alcohol with 9 moles ethylene oxide), marketed by The Procter & Gamble Company, and Genapol LA 030 or 050 (the condensation product of $C_{12}$–$C_{14}$ alcohol with 3 or 5 moles of ethylene oxide) marketed by Hoechst. Preferred range of HLB in these products is from 8–11 and most preferred from 8–10.

Also useful as the nonionic surfactant of the surfactant systems of the present invention are the alkylpolysaccharides disclosed in U.S. Pat. No. 4,565,647, LIenado, issued Jan. 21, 1986, having a hydrophobic group containing from about 6 to about 30 carbon atoms, preferably from about 10 to about 16 carbon atoms and a polysaccharide, e.g. a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties (optionally the hydrophobic group is attached at the 2-, 3-, 4-, etc. positions thus giving a glucose or galactose as opposed to a glucoside or galactoside). The intersaccharide bonds can be, e.g., between the one position of the additional saccharide units and the 2-, 3-, 4-, and/or 6-positions on the preceding saccharide units. The preferred alkylpolyglycosides have the formula $R^2O(C_nH_{2n}O)_t(glycosyl)_x$ wherein $R^2$ is selected from the group consisting of alkyl, alkylphenyl, hydroxyalkyl, hydroxyalkylphenyl, and mixtures thereof in which the alkyl groups contain from about 10 to about 18, preferably from about 12 to about 14, carbon atoms; n is 2 or 3, preferably 2; t is from 0 to about 10, preferably 0; and x is from about 1.3 to about 10, preferably from about 1.3 to about 3, most preferably from about 1.3 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominately the 2-position.

The condensation products of ethylene oxide with a hydrophobic base formed by the condensation of propylene oxide with propylene glycol are also suitable for use as the additional nonionic surfactant systems of the present invention. The hydrophobic portion of these compounds will preferably have a molecular weight of from about 1500 to about 1800 and will exhibit water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially-available Plurafac™ LF404 and Pluronic™ surfactants, marketed by BASF.

Also suitable for use as the nonionic surfactant of the nonionic surfactant system of the present invention, are the condensation products of ethylene oxide with the product resulting from the reaction of propylene oxide and ethylenediamine. The hydrophobic moiety of these products consists of the reaction product of ethylenediamine and excess propylene oxide, and generally has a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic™ compounds, marketed by BASF.

Preferred for use as the nonionic surfactant of the surfactant systems of the present invention are polyethylene oxide condensates of alkyl phenols, condensation products of primary and secondary aliphatic alcohols with from about 1 to about 25 moles of ethylene oxide, alkylpolysaccharides, and mixtures thereof. Most preferred are $C_8$–$C_{14}$ alkyl phenol ethoxylates having from 3 to 15 ethoxy groups and $C_8$–$C_{18}$ alcohol ethoxylates (preferably $C_{10}$ avg.) having from 2 to 10 ethoxy groups, and mixtures thereof.

Highly preferred nonionic surfactants are polyhydroxy fatty acid amide surfactants of the formula.

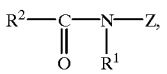

wherein $R^1$ is H, or $R^1$ is $C_{1-4}$ hydrocarbyl, 2-hydroxy ethyl, 2-hydroxy propyl or a mixture thereof, $R^2$ is $C_{5-31}$ hydrocarbyl, and Z is a polyhydroxyhydrocarbyl having a linear hydrocarbyl chain with at least 3 hydroxyls directly connected to the chain, or an alkoxylated derivative thereof. Preferably, $R^1$ is methyl, $R^2$ is a straight $C_{11-15}$ alkyl or $C_{16-18}$ alkyl or alkenyl chain such as coconut alkyl or mixtures thereof, and Z is derived from a reducing sugar such as glucose, fructose, maltose, lactose, in a reductive amination reaction.

Suitable anionic surfactants to be used are linear alkyl benzene sulfonate, alkyl ester sulfonate surfactants including linear esters of $C_8$–$C_{20}$ carboxylic acids (i.e., fatty acids) which are sulfonated with gaseous $SO_3$ according to "The Journal of the American Oil Chemists Society", 52 (1975), pp. 323–329. Suitable starting materials would include natural fatty substances as derived from tallow, palm oil, etc. The preferred alkyl ester sulfonate surfactant, especially for laundry applications, comprise alkyl ester sulfonate surfactants of the structural formula:

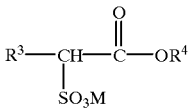

wherein $R^3$ is a $C_8$–$C_{20}$ hydrocarbyl, preferably an alkyl, or combination thereof, $R^4$ is a $C_1$–$C_6$ hydrocarbyl, preferably an alkyl, or combination thereof, and M is a cation which forms a water soluble salt with the alkyl ester sulfonate. Suitable salt-forming cations include metals such as sodium, potassium, and lithium, and substituted or unsubstituted ammonium cations, such as monoethanolamine, diethanolamine, and triethanolamine. Preferably, $R^3$ is $C_{10}$–$C_{16}$ alkyl, and $R^4$ is methyl, ethyl or isopropyl. Especially preferred are the methyl ester sulfonates wherein $R^3$ is $C_{10}$–$C_{16}$ alkyl.

Other suitable anionic surfactants include the alkyl sulfate surfactants which are water soluble salts or acids of the formula $ROSO_3M$ wherein R preferably is a $C_{10}$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation, e.g., an alkali metal cation (e.g. sodium, potassium, lithium), or ammonium or substituted ammonium (e.g. methyl-, dimethyl-, and trimethyl ammonium cations and quaternary ammonium cations such as tetramethyl-ammonium and dimethyl piperdinium cations and quaternary ammonium cations derived from alkylamines such as ethylamine, diethylamine, triethylamine, and mixtures thereof, and the like). Typically, alkyl chains of $C_{12}$–$C_{16}$ are preferred for lower wash temperatures (e.g. below about 50° C.) and $C_{16-18}$ alkyl chains are preferred for higher wash temperatures (e.g. above about 50° C.).

Other anionic surfactants useful for detersive purposes can also be included in the detergent compositions of the present invention. These can include salts (including, for example, sodium, potassium, ammonium, and substituted ammonium salts such as mono-, di- and triethanolamine salts) of soap, $C_8$–$C_{22}$ primary of secondary alkanesulfonates, $C_8$–$C_{24}$ olefinsulfonates, sulfonated polycarboxylic acids prepared by sulfonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl glycerol sulfonates, fatty acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinates (especially saturated and unsaturated $C_{12}$–$C_{18}$ monoesters) and diesters of sulfosuccinates (especially saturated and unsaturated $C_6$–$C_{12}$ diesters), acyl sarcosinates, sulfates of alkylpolysaccharides such as the sulfates of alkylpolyglucoside (the nonionic nonsulfated compounds being described below), branched primary alkyl sulfates, and alkyl polyethoxy carboxylates such as those of the formula $RO(CH_2CH_2O)_k$-$CH_2COO$-M+ wherein R is a $C_8$–$C_{22}$ alkyl, k is an integer from 1 to 10, and M is a soluble salt-forming cation. Resin acids and hydrogenated resin acids are also suitable, such as rosin, hydrogenated rosin, and resin acids and hydrogenated resin acids present in or derived from tall oil.

Further examples are described in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23 (herein incorporated by reference). When included therein, the laundry detergent compositions of the present invention typically comprise from about 1% to about 40%, preferably from about 3% to about 20% by weight of such anionic surfactants.

Highly preferred anionic surfactants include alkyl alkoxylated sulfate surfactants hereof are water soluble salts or acids of the formula $RO(A)_mSO3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl, trimethylammonium cations and quaternary ammonium cations such as tetramethyl-ammonium and dimethyl piperdinium cations and those derived from alkylamines such as ethylamine, diethylamine, triethylamine, mixtures thereof, and the like. Exemplary surfactants are $C_{12}$–$C_{18}$ alkyl polyethoxylate (1.0) sulfate ($C_{12}$–$C_{18}E(1.0)M$), $C_{12}$–$C_{18}$ alkyl polyethoxylate (2.25) sulfate ($C_{12}$–$C_{18}E(2.25)M$), $C_{12}$–$C_{18}$ alkyl polyethoxylate (3.0) sulfate ($C_{12}$–$C_{18}E(3.0)M$), and $C_{12}$–$C_{18}$ alkyl polyethoxylate (4.0) sulfate ($C_{12}$–$C_{18}E(4.0)M$), wherein M is conveniently selected from sodium and potassium.

The detergent compositions of the present invention may also contain cationic, ampholytic, zwitterionic, and semipolar surfactants, as well as the nonionic and/or anionic surfactants other than those already described herein.

Cationic detersive surfactants suitable for use in the detergent compositions of the present invention are those having one long-chain hydrocarbyl group. Examples of such cationic surfactants include the ammonium surfactants such as alkyltrimethylammonium halogenides, and those surfactants having the formula:

$$[R^2(OR^3)_y][R^4(OR^3)y]_2R^5N+X-$$

wherein $R^2$ is an alkyl or alkyl benzyl group having from about 8 to about 18 carbon atoms in the alkyl chain, each $R^3$ is selected from the group consisting of —$CH_2CH_2$—, —$CH_2CH(CH_3)$—, —$CH_2CH(CH_2OH)$—, —$CH_2CH_2CH_2$—, and mixtures thereof; each $R^4$ is selected from the group consisting of $C_1$–$C_4$ alkyl, $C_1$–$C_4$ hydroxyalkyl, benzyl ring structures formed by joining the two $R^4$ groups, —$CH_2CHOH$—$CHOHCOR^6CHOHCH_2OH$ wherein $R^6$ is any hexose or hexose polymer having a molecular weight less than about 1000, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Quaternary ammonium surfactant suitable for the present invention has the formula (I):

Formula I

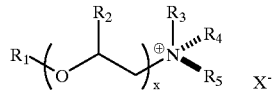

whereby R1 is a short chainlength alkyl (C6–C10) or alkylamidoalkyl of the formula (II):

Formula II

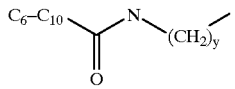

y is 2–4, preferably 3.

whereby R2 is H or a C1–C3 alkyl, whereby x is 0–4, preferably 0–2, most preferably 0, whereby R3, R4 and R5 are either the same or different and can be either a short chain alkyl (C1–C3) or alkoxylated alkyl of the formula III, whereby $X^-$ is a counterion, preferably a halide, e.g. chloride or methylsulfate.

Formula III

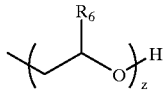

R6 is $C_1$–$C_4$ and z is 1 or 2.

Preferred quat ammonium surfactants are those as defined in formula I whereby $R_1$ is $C_8$, $C_{10}$ or mixtures thereof, x=O, $R_3$, $R_4$=$CH_3$ and $R_5$=$CH_2CH_2OH$.

Highly preferred cationic surfactants are the water-soluble quaternary ammonium compounds useful in the present composition having the formula:

$$R_1R_2R_3R_4N^+X^-(i)$$

wherein $R_1$ is $C_8$–$C_{16}$ alkyl, each of $R_2$, $R_3$ and $R_4$ is independently $C_1$–$C_4$ alkyl, $C_1$–$C_4$ hydroxy alkyl, benzyl, and —$(C_2H_{40})_xH$ where x has a value from 2 to 5, and X is an anion. Not more than one of $R_2$, $R_3$ or $R_4$ should be benzyl. The preferred alkyl chain length for $R_1$ is $C_{12}$–$C_{15}$ particularly where the alkyl group is a mixture of chain lengths derived from coconut or palm kernel fat or is derived synthetically by olefin build up or OXO alcohols synthesis. Preferred groups for $R_2R_3$ and $R_4$ are methyl and hydroxyethyl groups and the anion X may be selected from halide, methosulphate, acetate and phosphate ions. Examples of suitable quaternary ammonium compounds of formulae (i) for use herein are:

coconut trimethyl ammonium chloride or bromide;

coconut methyl dihydroxyethyl ammonium chloride or bromide;

decyl triethyl ammonium chloride;

decyl dimethyl hydroxyethyl ammonium chloride or bromide;

$C_{12-15}$ dimethyl hydroxyethyl ammonium chloride or bromide;

coconut dimethyl hydroxyethyl ammonium chloride or bromide;

myristyl trimethyl ammonium methyl sulphate;

lauryl dimethyl benzyl ammonium chloride or bromide;

lauryl dimethyl (ethenoxy)$_4$ ammonium chloride or bromide;

choline esters (compounds of formula (i) wherein $R_1$ is

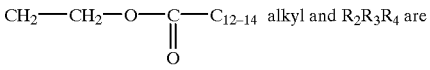

alkyl and $R_2R_3R_4$ are methyl).

di-alkyl imidazolines [compounds of formula (i)].

Other cationic surfactants useful herein are also described in U.S. Pat. No. 4,228,044, Cambre, issued Oct. 14, 1980 and in European Patent Application EP 000,224.

Typical cationic fabric softening components include the water-insoluble quaternary-ammonium fabric softening actives, the most commonly used having been di-long alkyl chain ammonium chloride or methyl sulfate. Preferred cationic softeners among these include the following:

1) ditallow dimethylammonium chloride (DTDMAC);

2) dihydrogenated tallow dimethylammonium chloride;

3) dihydrogenated tallow dimethylammonium methylsulfate;

4) distearyl dimethylammonium chloride;

5) dioleyl dimethylammonium chloride;

6) dipaimityl hydroxyethyl methylammonium chloride;

7) stearyl benzyl dimethylammonium chloride;

8) tallow trimethylammonium chloride;

9) hydrogenated tallow trimethylammonium chloride;

10) $C_{12-14}$ alkyl hydroxyethyl dimethylammonium chloride;

11) $C_{12-18}$ alkyl dihydroxyethyl methylammonium chloride;

12) di(stearoyloxyethyl) dimethylammonium chloride (DSOEDMAC);

13) di(tallowoyloxyethyl) dimethylammonium chloride;

14) ditallow imidazolinium methylsulfate;

15) 1-(2-tallowylamidoethyl)-2-tallowyl imidazolinium methylsulfate.

Biodegradable quaternary ammonium compounds have been presented as alternatives to the traditionally used di-long alkyl chain ammonium chlorides and methyl sulfates. Such quaternary ammonium compounds contain long chain alk(en)yl groups interrupted by functional groups such as carboxy groups. Said materials and fabric softening compositions containing them are disclosed in numerous publications such as EP-A-0,040,562, and EP-A-0,239,910. The quaternary ammonium compounds and amine precursors herein have the formula (I) or (II), below:

(I)

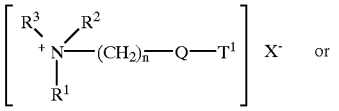

or (II)

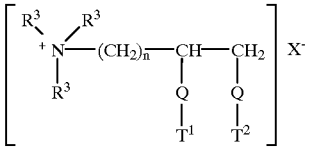

wherein

Q is selected from —O—C(O)—, —C(O)—O—, —O—C(O)—O—, —NR$^4$—C(O)—, —C(O)—NR$^4$—;

$R^1$ is $(CH_2)_n$—Q—$T^2$ or $T^3$;

$R^2$ is $(CH_2)_m$—Q—$T^4$ or $T^5$ or $R^3$;

$R^3$ is $C_1$–$C_4$ alkyl or $C_1$–$C_4$ hydroxyalkyl or H;

$R^4$ is H or $C_1$–$C_4$ alkyl or $C_1$–$C_4$ hydroxyalkyl;

$T^1$, $T^2$, $T^3$, $T^4$, $T^5$ are independently $C_{11}$–$C_{22}$ alkyl or alkenyl;

n and m are integers from 1 to 4; and $X^-$ is a softener-compatible anion.

Non-limiting examples of softener-compatible anions include chloride or methyl sulfate.

The alkyl, or alkenyl, chain $T^1$, $T^2$, $T^3$, $T^4$, $T^5$ must contain at least 11 carbon atoms, preferably at least 16 carbon atoms. The chain may be straight or branched.

Tallow is a convenient and inexpensive source of long chain alkyl and alkenyl material. The compounds wherein $T^1$, $T^2$, $T^3$, $T^4$, $T^5$ represents the mixture of long chain materials typical for tallow are particularly preferred.

Specific examples of quaternary ammonium compounds suitable for use in the aqueous fabric softening compositions herein include:

1) N,N-di(tallowyl-oxy-ethyl)-N,N-dimethyl ammonium chloride;

2) N,N-di(tallowyl-oxy-ethyl)-N-methyl, N-(2-hydroxyethyl) ammonium methyl sulfate;

3) N,N-di(2-tallowyl-oxy-2-oxo-ethyl)-N,N-dimethyl ammonium chloride;

4) N,N-di(2-tallowyl-oxy-ethylcarbonyl-oxy-ethyl)-N,N-dimethyl ammonium chloride;

5) N-(2-tallowyl-oxy-2-ethyl)-N-(2-tallowyl-oxy-2-oxo-ethyl)-N,N-dimethyl ammonium chloride;

6) N,N,N-tri(tallowyl-oxy-ethyl)-N-methyl ammonium chloride;

7) N-(2-tallowyl-oxy-2-oxo-ethyl)-N-(tallowyl-N,N-dimethyl-ammonium chloride; and 8) 1,2-ditallowyl-oxy-3-trimethylammoniopropane chloride; and mixtures of any of the above materials.

When included therein, the detergent compositions of the present invention typically comprise from 0.2% to about 25%, preferably from about 1% to about 8% by weight of such cationic surfactants.

Ampholytic surfactants are also suitable for use in the detergent compositions of the present invention. These surfactants can be broadly described as aliphatic derivatives of secondary or tertiary amines, or aliphatic derivatives of heterocyclic secondary and tertiary amines in which the aliphatic radical can be straight- or branched-chain. One of the aliphatic substituents contains at least about 8 carbon atoms, typically from about 8 to about 18 carbon atoms, and at least one contains an anionic water-solubilizing group, e.g. carboxy, sulfonate, sulfate. See U.S. Pat. No. 3,929,678 to Laughlin et al., issued Dec. 30, 1975 at column 19, lines 18–35, for examples of ampholytic surfactants.

When included therein, the detergent compositions of the present invention typically comprise from 0.2% to about 15%, preferably from about 1% to about 10% by weight of such ampholytic surfactants.

Zwitterionic surfactants are also suitable for use in detergent compositions. These surfactants can be broadly described as derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678 to Laughlin et al., issued Dec. 30, 1975 at column 19, line 38 through column 22, line 48, for examples of zwitterionic surfactants.

When included therein, the detergent compositions of the present invention typically comprise from 0.2% to about 15%, preferably from about 1% to about 10% by weight of such zwitterionic surfactants.

Semi-polar nonionic surfactants are a special category of nonionic surfactants which include water-soluble amine oxides containing one alkyl moiety of from about 10 to about 18 carbon atoms and 2 moieties selected from the group consisting of alkyl groups and hydroxyalkyl groups containing from about 1 to about 3 carbon atoms; water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 10 to about 18 carbon atoms and a moiety selected from the group consisting of alkyl and hydroxyalkyl moieties of from about 1 to about 3 carbon atoms. Semi-polar nonionic detergent surfactants include the amine oxide surfactants having the formula

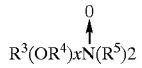

wherein $R^3$ is an alkyl, hydroxyalkyl, or alkyl phenyl group or mixtures therof containing from about 8 to about 22 carbon atoms; $R^4$ is an alkylene or hydroxyalkylene group containing from about 2 to about 3 carbon atoms or mixtures thereof; x is from 0 to about 3; and each $R^5$ is an alkyl or hydroxyalkyl group containing from about 1 to about 3 carbon atoms or a polyethylene oxide group containing from about 1 to about 3 ethylene oxide groups. The $R^5$ groups can be attached to each other, e.g., through an oxygen or nitrogen atom, to form a ring structure.

These amine oxide surfactants in particular include $C_{10}$–$C_{18}$ alkyl dimethyl amine oxides and $C_8$–$C_{12}$ alkoxy ethyl dihydroxy ethyl amine oxides.

When included therein, the detergent compositions of the present invention typically comprise from 0.2% to about 15%, preferably from about 1% to about 10% by weight of such semi-polar nonionic surfactants.

The detergent composition of the present invention may further comprise a cosurfactant selected from the group of primary or tertiary amines. Suitable primary amines for use herein include amines according to the formula $R_1NH_2$ wherein $R_1$ is a $C_6$–$C_{12}$, preferably $C_6$–$C_{10}$ alkyl chain or $R_4X(CH_2)_n$, X is —O—,—C(O)NH— or —NH—, $R_4$ is a $C_6$–$C_{12}$ alkyl chain n is between 1 to 5, preferably 3. $R_1$ alkyl chains may be straight or branched and may be interrupted with up to 12, preferably less than 5 ethylene oxide moieties. Preferred amines according to the formula herein above are n-alkyl amines. Suitable amines for use herein may be selected from 1-hexylamine, 1-octylamine, 1-decylamine and laurylamine. Other preferred primary amines include C8–C10 oxypropylamine, octyloxypropylamine, 2-ethylhexyl-oxypropylamine, lauryl amido propylamine and amido propylamine.

Suitable tertiary amines for use herein include tertiary amines having the formula $R_1R_2R_3N$ wherein $R_1$ and $R_2$ are $C_1$–$C_8$ alkyl chains or

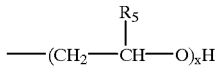

$R_3$ is either a $C_6$–$C_{12}$, preferably $C_6$–$C_{10}$ alkyl chain, or $R_3$ is $R_4X(CH_2)_n$, whereby X is —O—, —C(O)NH— or —NH—, $R_4$ is a $C_4$–$C_{12}$, n is between 1 to 5, preferably 2–3. $R_5$ is H or $C_1$–$C_2$ alkyl and x is between 1 to 6 . $R_3$ and $R_4$ may be linear or branched; $R_3$ alkyl chains may be interrupted with up to 12, preferably less than 5, ethylene oxide moieties.

Preferred tertiary amines are $R_1R_2R_3N$ where R1 is a C6–C12 alkyl chain, R2 and R3 are C1–C3 alkyl or

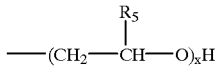

where R5 is H or CH3 and x=1–2.

Also preferred are the amidoamines of the formula:

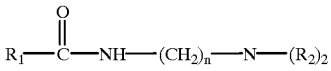

wherein $R_1$ is $C_6$–$C_{12}$ alkyl; n is 2–4, preferably n is 3; $R_2$ and $R_3$ is $C_1$–$C_4$ Most preferred amines of the present invention include 1-octylamine, 1-hexylamine, 1-decylamine, 1-dodecylamine, C8–10oxypropylamine, N coco 1-3diaminopropane, coconutalkyldimethylamine, lauryldimethylamine, lauryl bis(hydroxyethyl)amine, coco bis(hydroxyehtyl)amine, lauryl amine 2 moles propoxylated, octyl amine 2 moles propoxylated, lauryl amidopropyidimethylamine, C8–10 amidopropyldimethylamine and C10 amidopropyldimethylamine. The most preferred amines for use in the compositions herein are 1-hexylamine, 1-octylamine, 1-decylamine, 1-dodecylamine. Especially desirable are n-dodecyldimethylamine and bishydroxyethylcoconutalkylamine and oleylamine 7 times ethoxylated, lauryl amido propylamine and cocoamido propylamine.

Color Care and Fabric Care Benefits

Technologies which provide a type of color care benefit can also be included. Examples of these technologies are metallo catalysts for color maintenance. Such metallo catalysts are described in copending European Patent Application No. 92870181.2. Dye fixing agents, polyolefin dispersion for anti-wrinkles and improved water absorbancy, perfume and amino-functional polymer for color care treatment and perfume substantivity are further examples of color care/fabric care technologies and are described in the co-pending Patent Application No. 96870140.9, filed Nov. 07, 1996.

Fabric softening agents can also be incorporated into laundry detergent and/or fabric care compositions in accordance with the present invention. These agents may be inorganic or organic in type. Inorganic softening agents are exemplified by the smectite clays disclosed in GB-A-1 400 898 and in U.S. Pat. No. 5,019,292. Organic fabric softening agents include the water insoluble tertiary amines as disclosed in GB-A1 514 276 and EP-B0 011 340 and their combination with mono C12–C14 quaternary ammonium salts are disclosed in EP-B-0 026 527 and EP-B-0 026 528 and di-long-chain amides as disclosed in EP-B-0 242 919. Other useful organic ingredients of fabric softening systems include high molecular weight polyethylene oxide materials as disclosed in EP-A-0 299 575 and 0 313 146.

Levels of smectite clay are normally in the range from 2% to 20%, more preferably from 5% to 15% by weight, with the material being added as a dry mixed component to the remainder of the formulation. Organic fabric softening agents such as the water-insoluble tertiary amines or dilong chain amide materials are incorporated at levels of from 0.5% to 5% by weight, normally from 1% to 3% by weight whilst the high molecular weight polyethylene oxide materials and the water soluble cationic materials are added at levels of from 0.1% to 2%, normally from 0.15% to 1.5% by weight. These materials are normally added to the spray dried portion of the composition, although in some instances it may be more convenient to add them as a dry mixed particulate, or spray them as molten liquid on to other solid components of the composition.

Bleaching Agent

Additional optional detergent ingredients that can be included in the detergent compositions of the present invention include bleaching agents such as hydrogen peroxide, PB1, PB4 and percarbonate with a particle size of 400–800 microns. These bleaching agent components can include one or more oxygen bleaching agents and, depending upon the bleaching agent chosen, one or more bleach activators. When present oxygen bleaching compounds will typically be present at levels of from about 1% to about 25%.

The bleaching agent component for use herein can be any of the bleaching agents useful for detergent compositions including oxygen bleaches as well as others known in the art. The bleaching agent suitable for the present invention can be an activated or non-activated bleaching agent.

One category of oxygen bleaching agent that can be used encompasses percarboxylic acid bleaching agents and salts thereof. Suitable examples of this class of agents include magnesium monoperoxyphthalate hexahydrate, the magnesium salt of meta-chloro perbenzoic acid, 4-nonylamino-4-oxoperoxybutyric acid and diperoxydodecanedioic acid. Such bleaching agents are disclosed in U.S. Pat. No. 4,483,781, U.S. patent application Ser. No. 740,446, European Patent Application 0,133,354 and U.S. Pat. No. 4,412,934. Highly preferred bleaching agents also include 6-nonylamino-6-oxoperoxycaproic acid as described in U.S. Pat. No. 4,634,551. Another category of bleaching agents that can be used encompasses the halogen bleaching agents. Examples of hypohalite bleaching agents, for example, include trichloro isocyanuric acid and the sodium and potassium dichioroisocyanurates and N-chloro and N-bromo alkane sulphonamides. Such materials are normally added at 0.5–10% by weight of the finished product, preferably 1–5% by weight.

The hydrogen peroxide releasing agents can be used in combination with bleach activators such as tetraacetylethylenediamine (TAED), nonanoyloxybenzene-sulfonate (NOBS, described in U.S. Pat. No. 4,412,934), 3,5,-trimethylhexanoloxybenzenesulfonate (ISONOBS, described in EP 120,591) or pentaacetylglucose (PAG) or Phenolsulfonate ester of N-nonanoyl-6-aminocaproic acid (NACA-OBS, described in WO94/28106), which are perhydrolyzed to form a peracid as the active bleaching species, leading to improved bleaching effect. Also suitable activators are acylated citrate esters such as disclosed in Copending European Patent Application No. 91870207.7.

Useful bleaching agents, including peroxyacids and bleaching systems comprising bleach activators and peroxygen bleaching compounds for use in detergent compositions according to the invention are described in our co-pending applications U.S. Ser. No. 08/136,626, PCT/US95/07823, WO95/27772, WO95/27773, WO95/27774 and WO95/27775.

The hydrogen peroxide may also be present by adding an enzymatic system (i.e. an enzyme and a substrate therefore) which is capable of generating hydrogen peroxide at the beginning or during the washing and/or rinsing process. Such enzymatic systems are disclosed in EP Patent Application 91202655.6 filed Oct. 9, 1991.

Metal-containing catalysts for use in bleach compositions, include cobalt-containing catalysts such as Pentaamine acetate cobalt(III) salts and manganese-containing catalysts such as those described in EPA 549 271; EPA 549 272; EPA 458 397; U.S. Pat. No. 5,246,621; EPA 458 398; U.S. Pat. No. 5,194,416 and U.S. Pat. No. 5,114,611. Bleaching composition comprising a peroxy compound, a manganese-containing bleach catalyst and a chelating agent is described in the patent application No 94870206.3.

Bleaching agents other than oxygen bleaching agents are also known in the art and can be utilized herein. One type of non-oxygen bleaching agent of particular interest includes photoactivated bleaching agents such as the sulfonated zinc and/or aluminum phthalocyanines. These materials can be deposited upon the substrate during the washing process. Upon irradiation with light, in the presence of oxygen, such as by hanging clothes out to dry in the daylight, the sulfonated zinc phthalocyanine is activated and, consequently, the substrate is bleached. Preferred zinc phthalocyanine and a photoactivated bleaching process are described in U.S. Pat. No. 4,033,718. Typically, detergent compositions will contain about 0.025% to about 1.25%, by weight, of sulfonated zinc phthalocyanine.

Builder System

The compositions according to the present invention may further comprise a builder system. Any conventional builder system is suitable for use herein including aluminosilicate materials, silicates, polycarboxylates, alkyl- or alkenylsuccinic acid and fatty acids, materials such as ethylenediamine tetraacetate, diethylene triamine pentamethyleneacetate, metal ion sequestrants such as aminopolyphosphonates, particularly ethylenediamine tetramethylene phosphonic acid and diethylene triamine pentamethylenephosphonic acid. Phosphate builders can also be used herein.

Suitable builders can be an inorganic ion exchange material, commonly an inorganic hydrated aluminosilicate material, more particularly a hydrated synthetic zeolite such as hydrated zeolite A, X, B, HS or MAP.

Another suitable inorganic builder material is layered silicate, e.g. SKS-6 (Hoechst). SKS-6 is a crystalline layered silicate consisting of sodium silicate ($Na_2Si_2O_5$).

Suitable polycarboxylates containing one carboxy group include lactic acid, glycolic acid and ether derivatives thereof as disclosed in Belgian Patent Nos. 831,368, 821,369 and 821,370. Polycarboxylates containing two carboxy groups include the water-soluble salts of succinic acid, malonic acid, (ethylenedioxy) diacetic acid, maleic acid, diglycollic acid, tartaric acid, tartronic acid and fumaric acid, as well as the ether carboxylates described in German Offenlegenschrift 2,446,686, and 2,446,687 and U.S. Pat. No. 3,935,257 and the sulfinyl carboxylates described in Belgian Patent No. 840,623. Polycarboxylates containing three carboxy groups include, in particular, water-soluble citrates, aconitrates and citraconates as well as succinate derivatives such as the carboxymethyloxysuccinates described in British Patent No. 1,379,241, lactoxysuccinates described in Netherlands Application 7205873, and the oxypolycarboxylate materials such as 2-oxa-1,1,3-propane tricarboxylates described in British Patent No. 1,387,447.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,082,179, while polycarboxylates containing phosphone substituents are disclosed in British Patent No. 1,439,000.

Alicyclic and heterocyclic polycarboxylates include cyclopentane-cis,cis,cis-tetracarboxylates, cyclopentadienide pentacarboxylates, 2,3,4,5-tetrahydro-furan-cis, cis, cis-tetracarboxylates, 2,5-tetrahydro-furan-cis-dicarboxylates, 2,2,5,5-tetrahydrofuran-tetracarboxylates, 1,2,3,4,5,6-hexane-hexacar-boxylates and carboxymethyl derivatives of polyhydric alcohols such as sorbitol, mannitol and xylitol. Aromatic poly-carboxylates include mellitic acid, pyromellitic acid and the phthalic acid derivatives disclosed in British Patent No. 1,425,343.

Of the above, the preferred polycarboxylates are hydroxycarboxylates containing up to three carboxy groups per molecule, more particularly citrates.

Preferred builder systems for use in the present compositions include a mixture of a water-insoluble aluminosilicate builder such as zeolite A or of a layered silicate (SKS-6), and a water-soluble carboxylate chelating agent such as citric acid.

Preferred builder systems include a mixture of a water-insoluble aluminosilicate builder such as zeolite A, and a watersoluble carboxylate chelating agent such as citric acid. Preferred builder systems for use in liquid detergent compositions of the present invention are soaps and polycarboxylates.

Other builder materials that can form part of the builder system for use in granular compositions include inorganic materials such as alkali metal carbonates, bicarbonates, silicates, and organic materials such as the organic phosphonates, amino polyalkylene phosphonates and amino polycarboxylates.

Other suitable water-soluble organic salts are the homo- or co-polymeric acids or their salts, in which the polycarboxylic acid comprises at least two carboxyl radicals separated from each other by not more than two carbon atoms. Polymers of this type are disclosed in GB-A-1,596,756. Examples of such salts are polyacrylates of MW 2000–5000 and their copolymers with maleic anhydride, such copolymers having a molecular weight of from 20,000 to 70,000, especially about 40,000.

Detergency builder salts are normally included in amounts of from 5% to 80% by weight of the composition preferably from 10% to 70% and most usually from 30% to 60% by weight.

Chelating Agents

The detergent compositions herein may also optionally contain one or more iron and/or manganese chelating agents. Such chelating agents can be selected from the group consisting of amino carboxylates, amino phosphonates, polyfunctionally-substituted aromatic chelating agents and mixtures therein, all as hereinafter defined. Without intending to be bound by theory, it is believed that the benefit of these materials is due in part to their exceptional ability to remove iron and manganese ions from washing solutions by formation of soluble chelates.

Amino carboxylates useful as optional chelating agents include ethylenediaminetetracetates, N-hydroxyethylethylenediaminetriacetates, nitrilotriacetates, ethylenediamine tetraproprionates, triethylenetetraaminehexacetates, diethylenetriaminepentaacetates, and ethanoldiglycines, alkali metal, ammonium, and substituted ammonium salts therein and mixtures therein.

Amino phosphonates are also suitable for use as chelating agents in the compositions of the invention when at lease low levels of total phosphorus are permitted in detergent compositions, and include ethylenediaminetetrakis (methylenephosphonates) as DEQUEST. Preferred, these amino phosphonates to not contain alkyl or alkenyl groups with more than about 6 carbon atoms.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelator for use herein is ethylenediamine disuccinate ("EDDS"), especially the [S,S] isomer as described in U.S. Pat. No. 4,704,233, Nov. 3, 1987, to Hartman and Perkins.

The compositions herein may also contain water-soluble methyl glycine diacetic acid (MGDA) salts (or acid form) as a chelant or co-builder useful with, for example, insoluble builders such as zeolites, layered silicates and the like.

If utilized, these chelating agents will generally comprise from about 0.1% to about 15% by weight of the detergent compositions herein. More preferably, if utilized, the chelating agents will comprise from about 0.1% to about 3.0% by weight of such compositions.

Suds Suppressor

Another optional ingredient is a suds suppressor, exemplified by silicones, and silica-silicone mixtures. Silicones can be generally represented by alkylated polysiloxane materials while silica is normally used in finely divided forms exemplified by silica aerogels and xerogels and hydrophobic silicas of various types. These materials can be incorporated as particulates in which the suds suppressor is advantageously releasably incorporated in a water-soluble or water-dispersible, substantially non-surface-active detergent impermeable carrier. Alternatively the suds suppressor can be dissolved or dispersed in a liquid carrier and applied by spraying on to one or more of the other components.

A preferred silicone suds controlling agent is disclosed in Bartollota et al. U.S. Pat. No. 3,933,672. Other particularly useful suds suppressors are the self-emulsifying silicone suds suppressors, described in German Patent Application DTOS 2 646 126 published Apr. 28, 1977. An example of such a compound is DC-544, commercially available from Dow Corning, which is a siloxane-glycol copolymer. Especially preferred suds controlling agent are the suds suppressor system comprising a mixture of silicone oils and 2-alkyl-alcanols. Suitable 2-alkyl-alkanols are 2-butyl-octanol which are commercially available under the trade name Isofol 12 R. Such suds suppressor system are described in Copending European Patent application N 92870174.7 filed Nov. 10, 1992.

Especially preferred silicone suds controlling agents are described in Copending European Patent application N°92201649.8. Said compositions can comprise a silicone/silica mixture in combination with fumed nonporous silica such as Aerosil$^R$.

The suds suppressors described above are normally employed at levels of from 0.001% to 2% by weight of the composition, preferably from 0.01% to 1% by weight.

Dispersants

The cleaning composition of the present invention can also contain dispersants: Suitable water-soluble organic salts are the homo- or co-polymeric acids or their salts, in which the polycarboxylic acid comprises at least two carboxyl radicals separated from each other by not more than two carbon atoms. Polymers of this type are disclosed in GB-A-1,596,756. Examples of such salts are polyacrylates of MW 2000–5000 and their copolymers with maleic anhydride, such copolymers having a molecular weight of from 1,000 to 100,000.

Especially, copolymer of acrylate and methylacrylate such as the 480N having a molecular weight of 4000, at a level from 0.5–20% by weight of composition can be added in the cleaning compositions of the present invention.

The compositions of the invention may contain a lime soap peptiser compound, which has preferably a lime soap dispersing power (LSDP), as defined hereinafter of no more than 8, preferably no more than 7, most preferably no more than 6. The lime soap peptiser compound is preferably present at a level from 0% to 20% by weight.

A numerical measure of the effectiveness of a lime soap peptiser is given by the lime soap dispersant power (LSDP) which is determined using the lime soap dispersant test as described in an article by H. C. Borghetty and C. A. Bergman, J. Am. Oil. Chem. Soc., volume 27, pages 88–90, (1950). This lime soap dispersion test method is widely used by practitioners in this art field being referred to, for example, in the following review articles; W. N. Linfield, Surfactant science Series, Volume 7, page 3; W. N. Linfield, Tenside surf. det., volume 27, pages 159–163, (1990); and M. K. Nagarajan, W. F. Masler, Cosmetics and Toiletries, volume 104, pages 71–73, (1989). The LSDP is the % weight ratio of dispersing agent to sodium oleate required to disperse the lime soap deposits formed by 0.025 g of sodium oleate in 30 ml of water of 333ppm $CaCo_3$ (Ca:Mg=3:2) equivalent hardness.

Surfactants having good lime soap peptiser capability will include certain amine oxides, betaines, sulfobetaines, alkyl ethoxysulfates and ethoxylated alcohols.

Exemplary surfactants having a LSDP of no more than 8 for use in accord with the present invention include $C_{16}$–$C_{18}$ dimethyl amine oxide, $C_{12}$–$C_{18}$ alkyl ethoxysulfates with an average degree of ethoxylation of from 1–5, particularly $C_{12}$–$C_{15}$ alkyl ethoxysulfate surfactant with a degree of ethoxylation of amount 3 (LSDP=4), and the $C_{14}$–$C_{15}$ ethoxylated alcohols with an average degree of ethoxylation of either 12 (LSDP=6) or 30, sold under the tradenames Lutensol A012 and Lutensol A030 respectively, by BASF GmbH.

Polymeric lime soap peptisers suitable for use herein are described in the article by M. K. Nagarajan, W. F. Masler, to be found in Cosmetics and Toiletries, volume 104, pages 71–73, (1989).

Hydrophobic bleaches such as 4-[N-octanoyl-6-aminohexanoyl]benzene sulfonate, 4-[N-nonanoyl-6-aminohexanoyl]benzene sulfonate, 4-[N-decanoyl-6-aminohexanoyl]benzene sulfonate and mixtures thereof; and nonanoyloxy benzene sulfonate together with hydrophilic/hydrophobic bleach formulations can also be used as lime soap peptisers compounds.

Others

Other components used in detergent compositions may be employed, such as soil-suspending agents, optical brighteners, abrasives, bactericides, tarnish inhibitors, coloring agents, and/or encapsulated or non-encapsulated perfumes.

Especially suitable encapsulating materials are water soluble capsules which consist of a matrix of polysaccharide and polyhydroxy compounds such as described in GB 1,464,616.

Other suitable water soluble encapsulating materials comprise dextrins derived from ungelatinized starch acid-esters of substituted dicarboxylic acids such as described in U.S. Pat. No. 3,455,838. These acid-ester dextrins are, preferably, prepared from such starches as waxy maize, waxy sorghum, sago, tapioca and potato. Suitable examples of said encapsulating materials include N-Lok manufactured by National Starch. The N-Lok encapsulating material consists of a modified maize starch and glucose. The starch is modified by adding monofunctional substituted groups such as octenyl succinic acid anhydride.

Antiredeposition and soil suspension agents suitable herein include cellulose derivatives such as methylcellulose, carboxymethylcellulose and hydroxyethylcellulose, and homo- or co-polymeric polycarboxylic acids or their salts. Polymers of this type include the polyacrylates and maleic anhydrideacrylic acid copolymers previously mentioned as builders, as well as copolymers of maleic anhydride with ethylene, methylvinyl ether or methacrylic acid, the maleic anhydride constituting at least 20 mole percent of the copolymer. These materials are normally used at levels of from 0.5% to 10% by weight, more preferably from 0.75% to 8%, most preferably from 1% to 6% by weight of the composition.

Preferred optical brighteners are anionic in character, examples of which are disodium 4,4'-bis-(2-diethanolamino4-anilino-s-triazin-6-ylamino)stilbene-2:2'disulphonate, disodium 4, -4'-bis-(2-morpholino4-anilino-s-triazin-6-ylamino-stilbene-2:2'-disulphonate, disodium 4,4'-bis-(2,4-dianilino-s-triazin-6-ylamino) stilbene-2:2'-disulphonate, monosodium 4',4"-bis-(2,4-dianilino-s-triazin-6 ylamino)stilbene-2-sulphonate, disodium 4,4'-bis-(2-anilino4-(N-methyl-N-2-hydroxyethylamino)-s-triazin-6-ylamino)stilbene-2,2'-disulphonate, di-sodium 4,4'-bis-(4-phenyl-2,1,3-triazol-2-yl)-stilbene-2,2'disulphonate, di-sodium 4,4'bis(2-anilino4-(1-methyl-2-hydroxyethylamino)-s-triazin-6-ylami-no) stilbene-2,2'disulphonate, sodium 2(stilbyl-4"-(naphtho-1',2',4,5)-1,2,3-triazole-2"-sulphonate and 4,4'-bis(2-sulphostyryl)biphenyl. Highly preferred brighteners are the specific brighteners of copending European Patent application No. 95201943.8.

Other useful polymeric materials are the polyethylene glycols, particularly those of molecular weight 1000–10000, more particularly 2000 to 8000 and most preferably about 4000. These are used at levels of from 0.20% to 5% more preferably from 0.25% to 2.5% by weight. These polymers and the previously mentioned homo- or co-polymeric polycarboxylate salts are valuable for improving whiteness maintenance, fabric ash deposition, and cleaning performance on clay, proteinaceous and oxidizable soils in the presence of transition metal impurities.

Is is well known in the art that free chlorine in tap water rapidly deactivates the enzymes comprised in detergent compositions. Therefore, using chlorine scavenger such as perborate, ammonium sulfate, sodium sulphite or polyethyleneimine at a level above 0.1% by weight of total composition, in the formulas will provide improved through the wash stability of the detergent enzymes. Compositions comprising chlorine scavenger are described in the European patent application 92870018.6 filed Jan. 31, 1992.

Alkoxylated polycarboxylates such as those prepared from polyacrylates are useful herein to provide additional grease removal performance. Such materials are described in WO 91/08281 and PCT 90/01815 at p. 4 et seq., incorporated herein by reference. Chemically, these materials comprise polyacrylates having one ethoxy side-chain per every 7–8 acrylate units. The side-chains are of the formula $—(CH_2CH_2O)_{(CH2)}{}_m CH_3$ wherein m is 2–3 and n is 6–12. The side-chains are ester-linked to the polyacrylate "backbone" to provide a "comb" polymer type structure. The molecular weight can vary, but is typically in the range of about 2000 to about 50,000. Such alkoxylated polycarboxylates can comprise from about 0.05% to about 10%, by weight, of the compositions herein.

Dye Transfer Inhibition

The detergent compositions of the present invention can also include compounds for inhibiting dye transfer from one fabric to another of solubilized and suspended dyes encountered during fabric laundering operations involving colored fabrics.

Polymeric Dye Transfer Inhibiting Agents

The detergent compositions according to the present invention also comprise from 0.001% to 10%, preferably from 0.01% to 2%, more preferably from 0.05% to 1% by weight of polymeric dye transfer inhibiting agents. Said polymeric dye transfer inhibiting agents are normally incorporated into detergent compositions in order to inhibit the transfer of dyes from colored fabrics onto fabrics washed therewith. These polymers have the ability to complex or adsorb the fugitive dyes washed out of dyed fabrics before the dyes have the opportunity to become attached to other articles in the wash. Especially suitable polymeric dye transfer inhibiting agents are polyamine N-oxide polymers, copolymers of N-vinylpyrrolidone and N-vinylimidazole, polyvinylpyrrolidone polymers, polyvinyloxazolidones and polyvinylimidazoles or mixtures thereof. Addition of such polymers also enhances the performance of the enzymes according the invention.

a) Polyamine N-oxide Polymers

The polyamine N-oxide polymers suitable for use contain units having the following structure formula:

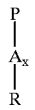

(I)

wherein

P is a polymerisable unit, whereto the R—N—O group can be attached to or wherein the R—N—O group forms part of the polymerisable unit or a combination of both.

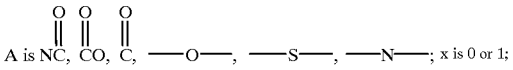

R are aliphatic, ethoxylated aliphatics, aromatic, heterocyclic or alicyclic groups or any combination thereof whereto the nitrogen of the N—O group can be attached or wherein the nitrogen of the N—O group is part of these groups.

The N—O group can be represented by the following general structures:

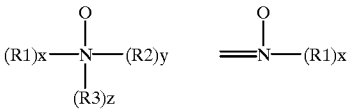

wherein

R1, R2, and R3 are aliphatic groups, aromatic, heterocyclic or alicyclic groups or combinations thereof, x or/and y or/and z is 0 or 1 and wherein the nitrogen of the N—O group can be attached or wherein the nitrogen of the N—O group forms part of these groups.

The N—O group can be part of the polymerisable unit (P) or can be attached to the polymeric backbone or a combination of both. Suitable polyamine N-oxides wherein the N—O group forms part of the polymerisable unit comprise polyamine N-oxides wherein R is selected from aliphatic, aromatic, alicyclic or heterocyclic groups. One class of said polyamine N-oxides comprises the group of polyamine N-oxides wherein the nitrogen of the N—O group forms part of the R-group. Preferred polyamine N-oxides are those wherein R is a heterocyclic group such as pyrridine, pyrrole, imidazole, pyrrolidine, piperidine, quinoline, acridine and derivatives thereof. Another class of said polyamine N-oxides comprises the group of polyamine N-oxides wherein the nitrogen of the N—O group is attached to the R-group.

Other suitable polyamine N-oxides are the polyamine oxides whereto the N—O group is attached to the polymerisable unit. Preferred class of these polyamine N-oxides are the polyamine N-oxides having the general formula (I) wherein R is an aromatic, heterocyclic or alicyclic groups wherein the nitrogen of the N—O functional group is part of said R group. Examples of these classes are polyamine oxides wherein R is a heterocyclic compound such as pyrridine, pyrrole, imidazole and derivatives thereof. Another preferred class of polyamine N-oxides are the polyamine oxides having the general formula (I) wherein R are aromatic, heterocyclic or alicyclic groups wherein the nitrogen of the N—O functional group is attached to said R groups.

Examples of these classes are polyamine oxides wherein R groups can be aromatic such as phenyl.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof.

The amine N-oxide polymers of the present invention typically have a ratio of amine to the amine N-oxide of 10:1 to 1:1000000. However the amount of amine oxide groups present in the polyamine oxide polymer can be varied by appropriate copolymerization or by appropriate degree of N-oxidation. Preferably, the ratio of amine to amine N-oxide is from 2:3 to 1:1000000. More preferably from 1:4 to 1:1000000, most preferably from 1:7 to 1:1000000. The polymers of the present invention actually encompass random or block copolymers where one monomer type is an amine N-oxide and the other monomer type is either an amine N-oxide or not. The amine oxide unit of the polyamine N-oxides has a PKa<10, preferably PKa<7, more preferred PKa<6. The polyamine oxides can be obtained in almost any degree of polymerisation. The degree of polymerisation is not critical provided the material has the desired water-solubility and dye-suspending power.

Typically, the average molecular weight is within the range of 500 to 1000,000; preferably from 1,000 to 50,000, more preferably from 2,000 to 30,000, most preferably from 3,000 to 20,000.

b) Copolymers of N-vinylpyrrolidone and N-vinylimidazole

The N-vinylimidazole N-vinylpyrrolidone polymers used in the present invention have an average molecular weight range from 5,000–1,000,000, preferably from 5,000–200,000.

Highly preferred polymers for use in detergent compositions according to the present invention comprise a polymer selected from N-vinylimidazole N-vinylpyrrolidone copolymers wherein said polymer has an average molecular weight range from 5,000 to 50,000 more preferably from 8,000 to 30,000, most preferably from 10,000 to 20,000. The average molecular weight range was determined by light scattering as described in Barth H. G. and Mays J. W. Chemical Analysis Vol 113,"Modern Methods of Polymer Characterization". Highly preferred N-vinylimidazole N-vinylpyrrolidone copolymers have an average molecular weight range from 5,000 to 50,000; more preferably from 8,000 to 30,000; most preferably from 10,000 to 20,000.

The N-vinylimidazole N-vinylpyrrolidone copolymers characterized by having said average molecular weight range provide excellent dye transfer inhibiting properties while not adversely affecting the cleaning performance of detergent compositions formulated therewith. The N-vinylimidazole N-vinylpyrrolidone copolymer of the present invention has a molar ratio of N-vinylimidazole to N-vinylpyrrolidone from 1 to 0.2, more preferably from 0.8 to 0.3, most preferably from 0.6 to 0.4.

c) Polyvinylpyrrolidone

The detergent compositions of the present invention may also utilize polyvinylpyrrolidone ("PVP") having an average molecular weight of from about 2,500 to about 400,000, preferably from about 5,000 to about 200,000, more preferably from about 5,000 to about 50,000, and most preferably from about 5,000 to about 15,000. Suitable polyvinylpyrrolidones are commercially vailable from ISP Corporation, New York, N.Y. and Montreal, Canada under the product names PVP K-15 (viscosity molecular weight of 10,000), PVP K-30 (average molecular weight of 40,000), PVP K-60 (average molecular weight of 160,000), and PVP K-90 (average molecular weight of 360,000). Other suitable polyvinylpyrrolidones which are commercially available from BASF Cooperation include Sokalan HP 165 and Sokalan HP 12; polyvinylpyrrolidones known to persons skilled in the detergent field (see for example EP-A-262,897 and EP-A-256,696).

d) Polyvinyloxazolidone

The detergent compositions of the present invention may also utilize polyvinyloxazolidone as a polymeric dye transfer inhibiting agent. Said polyvinyloxazolidones have an average molecular weight of from about 2,500 to about 400,000, preferably from about 5,000 to about 200,000, more preferably from about 5,000 to about 50,000, and most preferably from about 5,000 to about 15,000.

e) Polyvinylimidazole

The detergent compositions of the present invention may also utilize polyvinylimidazole as polymeric dye transfer inhibiting agent. Said polyvinylimidazoles have an average about 2,500 to about 400,000, preferably from about 5,000 to about 200,000, more preferably from about 5,000 to about 50,000, and most preferably from about 5,000 to about 15,000.

f) Cross-linked polymers

Cross-linked polymers are polymers whose backbone are interconnected to a certain degree; these links can be of chemical or physical nature, possibly with active groups n the backbone or on branches; cross-linked polymers have been described in the Journal of Polymer Science, volume 22, pages 1035–1039.

In one embodiment, the cross-linked polymers are made in such a way that they form a three-dimensional rigid structure, which can entrap dyes in the pores formed by the three-dimensional structure. In another embodiment, the cross-linked polymers entrap the dyes by swelling.

Such cross-linked polymers are described in the co-pending patent application 94870213.9

Method of Washing

The compositions of the invention may be used in essentially any washing or cleaning methods, including soaking methods, pretreatment methods and methods with rinsing steps for which a separate rinse aid composition may be added.

The process described herein comprises contacting fabrics with a laundering solution in the usual manner and exemplified hereunder.

The process of the invention is conveniently carried out in the course of the cleaning process. The method of cleaning is preferably carried out at 5° C. to 95° C., especially between 10° C. and 60° C. The pH of the treatment solution is preferably from 7 to 12.

A preferred machine dishwashing method comprises treating soiled articles with an aqueous liquid having dissolved or dispensed therein an effective amount of the machine diswashing or rinsing composition. A conventional effective amount of the machine dishwashing composition means from 8–60 g of product dissolved or dispersed in a wash volume from 3–10 liters.

According to a manual dishwashing method, soiled dishes are contacted with an effective amount of the diswashing composition, typically from 0.5–20 g (per 25 dishes being treated). Preferred manual dishwashing methods include the application of a concentrated solution to the surfaces of the dishes or the soaking in large volume of dilute solution of the detergent composition.

The following examples are meant to exemplify compositions of the present invention, but are not necessarily meant to limit or otherwise define the scope of the invention.

In the detergent compositions, the enzymes levels are expressed by pure enzyme by weight of the total composition and unless otherwise specified, the detergent ingredients are expressed by weight of the total compositions. The abbreviated component identifications therein have the following meanings:

| | |
|---|---|
| LAS | Sodium linear $C_{11-13}$ alkyl benzene sulphonate. |
| TAS | Sodium tallow alkyl sulphate. |
| CxyAS | Sodium $C_{1x}$–$C_{1y}$ alkylsulfate. |
| CxySAS | Sodium $C_{1x}$–$C_{1y}$ secondary (2, 3) alkyl sulfate. |

-continued

| | |
|---|---|
| CxyEz | $C_{1x}$–$C_{1y}$ predominantly linear primary alcohol condensed with an average of z moles of ethylene oxide. |
| CxyEzS | $C_{1x}$–$C_{1y}$ sodium alkyl sulfate condensed with an average of z moles of ethylene oxide. |
| QAS | $R_2.N+(CH_3)_2(C_2H_4OH)$ with $R_2 = C_{12}$–$C_{14}$. |
| QAS 1 | $R_2.N+(CH_3)_2(C_2H_4OH)$ with $R_2 = C_8$–$C_{11}$. |
| APA | $C_{8-10}$ amido propyl dimethyl amine. |
| Soap | Sodium linear alkyl carboxylate derived from a 80/20 mixture of tallow and coconut fatty acids. |
| Nonionic | $C_{13}$–$C_{15}$ mixed ethoxylated/propoxylated fatty alcohol with an average degree of ethoxylation of 3.8 and an average degree of propoxylation of 4.5. |
| STS | Sodium toluene sulphonate. |
| CFAA | $C_{12}$–$C_{14}$ alkyl N-methyl glucamide. |
| TFAA | $C_{16}$–$C_{18}$ alkyl N-methyl glucamide. |
| TPKFA | $C_{12}$–$C_{14}$ topped whole cut fatty acids. |
| DEQA | Di-(tallow-oxy-ethyl) dimethyl ammonium chloride. |
| DEQA (2) | Di-(soft-tallowyloxyethyl) hydroxyethyl methyl ammonium methylsulfate. |
| DTDMAMS | Ditalllow dimethyl ammonium methylsulfate. |
| SDASA | 1:2 ratio of stearyldimethyl amine:triple-pressed stearic acid. |
| Silicate | Amorphous Sodium Silicate ($SiO_2$: $Na_2O$ ratio = 1.6–3.2). |
| Metasilicate | Sodium metasilicate ($SiO_2$:$Na_2O$ ratio = 1.0). |
| Zeolite A | Hydrated Sodium Aluminosilicate of formula $Na_{12}(A1O_2SiO_2)_{12}.27H_2O$ having a primary particle size in the range from 0.1 to 10 micrometers (Weight expressed on an anhydrous basis). |
| Na-SKS-6 | Crystalline layered silicate of formula δ-$Na_2Si_2O_5$. |
| Citrate | Tri-sodium citrate dihydrate of activity 86.4% with a particle size distribution between 425 and 850 micrometers. |
| Citric | Anhydrous citric acid. |
| Borate | Sodium borate |
| Carbonate | Anhydrous sodium carbonate with a particle size between 200 and 900 micrometers. |
| Bicarbonate | Anhydrous sodium hydrogen carbonate with a particle size distribution between 400 and 1200 micrometers. |
| Sulphate | Anhydrous sodium sulphate. |
| Mg Sulphate | Anhydrous magnesium sulfate. |
| STPP | Sodium tripolyphosphate. |
| TSPP | Tetrasodium pyrophosphate. |
| MA/AA | Random copolymer of 4:1 acrylate/maleate, average molecular weight about 70,000–80,000. |
| MA/AA 1 | Random copolymer of 6:4 acrylate/maleate, average molecular weight about 10,000. |
| AA | Sodium polyacrylate polymer of average molecular weight 4,500. |
| PA30 | Polyacrylic acid of average molecular weight of between about 4,500–8,000. |
| 480N | Random copolymer of 7:3 acrylate/methacrylate, average molecular weight about 3,500. |
| Polygel/carbopol | High molecular weight crosslinked polyacrylates. |
| PB1 | Anhydrous sodium perborate monohydrate of nominal formula $NaBO_2.H_2O_2$. |
| PB4 | Sodium perborate tetrahydrate of nominal formula $NaBO_2.3H_2O.H_2O_2$. |
| Percarbonate | Anhydrous sodium percarbonate of nominal formula $2Na_2CO_3.3H_2O_2$. |
| NaDCC | Sodium dichloroisocyanurate. |
| TAED | Tetraacetylethylenediamine. |
| NOBS | Nonanoyloxybenzene sulfonate in the form of the sodium salt. |
| NACA-OBS | (6-nonamidocaproyl) oxybenzene sulfonate. |
| DTPA | Diethylene triamine pentaacetic acid. |
| HEDP | 1,1-hydroxyethane diphosphonic acid. |
| DETPMP | Diethyltriamine penta (methylene) phosphonate, marketed by Monsanto under the Trade name Dequest 2060. |
| EDDS | Ethylenediamine-N,N'-disuccinic acid, (S, S) isomer in the form of its sodium salt |
| MnTACN | Manganese 1,4,7-trimethyl-1,4,7-triazacyclononane. |
| Photoactivated Bleach | Sulfonated zinc phtalocyanine encapsulated in dextrin soluble polymer. |
| Photoactivated Bleach 1 | Sulfonated alumino phtalocyanine encapsulated in dextrin soluble polymer. |
| PAAC | Pentaamine acetate cobalt(III) salt. |

-continued

| | |
|---|---|
| Paraffin | Paraffin oil sold under the tradename Winog 70 by Wintershall. |
| NaBz | Sodium benzoate. |
| BzP | Benzoyl Peroxide. |
| Acid-thiol ligase | Fatty Acid Acyl CoA Synthetase and/or Fatty Acid Acyl ACP Synthetase sold by Sigma or Boehringer Mannheim. |
| Desaturase | Fatty Acid ACP Desaturase sold by Dupont. |
| Glutathione transferase | Glutathione S-transferases sold under the tradename G6636 and/or G8642 by Sigma. |
| Esterification compound | Coenzyme A sold by Sigma or Boehringer Mannheim. |
| Source of energy | Adenosine tripolyphosphate (ATP) sold by Sigma or Boehringer Mannheim. |
| Electron donor system | Ferredoxine, NADPH, Ferredoxine:NADPH |
| Protease | Proteolytic enzyme sold under the tradename Savinase, Alcalase, Durazym by Novo Nordisk NS, Maxacal, Maxapem sold by Gist-Brocades and proteases described in patents WO91/06637 and/or WO95/10591 and/or EP 251 446. |
| Amylase | Amylolytic enzyme sold under the tradename Purafact Ox $Am^R$ described in WO 94/18314, WO96/05295 sold by Genencor; Termamyl ®, Fungamyl ® and Duramyl ®, all available from Novo Nordisk A/S and those described in WO95/26397. |
| Lipase | Lipolytic enzyme sold under the tradename Lipolase, Lipolase Ultra by Novo Nordisk A/S and Lipomax by Gist-Brocades. |
| Cellulase | Cellulytic enzyme sold under the tradename Carezyme, Celluzyme and/or Endolase by Novo Nordisk A/S. |
| CMC | Sodium carboxymethyl cellulose. |
| PVP | Polyvinyl polymer, with an average molecular weight of 60,000. |
| PVNO | Polyvinylpyridine-N-Oxide, with an average molecular weight of 50,000. |
| PVPVI | Copolymer of vinylimidazole and vinylpyrrolidone, with an average molecular weight of 20,000. |
| Brightener 1 | Disodium 4,4'-bis(2-sulphostyryl)biphenyl. |
| Brightener 2 | Disodium 4,4'-bis(4-anilino-6-morpholino-1.3.5-triazin-2-yl) stilbene-2:2'-disulfonate. |
| Silicone antifoam | Polydimethylsiloxane foam controller with siloxane-oxyalkylene copolymer as dispersing agent with a ratio of said foam controller to said dispersing agent of 10:1 to 100:1. |
| Suds Suppressor | 12% Silicone/silica, 18% stearyl alcohol, 70% starch in granular form. |
| Opacifier | Water based monostyrene latex mixture, sold by BASF Aktiengesellschaft under the tradename Lytron 621. |
| SRP 1 | Anionically end capped poly esters. |
| SRP 2 | Diethoxylated poly (1,2 propylene terephtalate) short block polymer. |
| QEA | $bis((C_2H_5O)(C_2H_4O)_n)(CH_3)—N^+—C_6H_{12}—N^+—(CH_3)$ $bis((C_2H_5O)—(C_2H_4O))_n$, wherein n = from 20 to 30. |
| PEI | Polyethyleneimine with an average molecular weight of 1800 and an average ethoxylation degree of 7 ethyleneoxy residues per nitrogen. |
| SCS | Sodium cumene sulphonate. |
| HMWPEO | High molecular weight polyethylene oxide. |
| PEGx | Polyethylene glycol, of a molecular weight of x. |
| PEO | Polyethylene oxide, with an average molecular weight of 5,000. |
| TEPAE | Tetreaethylenepentaamine ethoxylate. |
| BTA | Benzotriazole. |
| pH | Measured as a 1% solution in distilled water at 20° C. |

EXAMPLE 1

The following high density laundry detergent compositions were prepared according to the present invention:

| | I | II | III | IV | V | VI |
|---|---|---|---|---|---|---|
| LAS | 8.0 | 8.0 | 8.0 | 2.0 | 6.0 | 6.0 |
| TAS | — | 0.5 | — | 0.5 | 1.0 | 0.1 |
| C46(S)AS | 2.0 | 2.5 | — | — | — | — |
| C25AS | — | — | — | 7.0 | 4.5 | 5.5 |
| C68AS | 2.0 | 5.0 | 7.0 | — | — | — |
| C25E5 | — | — | 3.4 | 10.0 | 4.6 | 4.6 |
| C25E7 | 3.4 | 3.4 | 1.0 | — | — | — |
| C25E3S | — | — | — | 2.0 | 5.0 | 4.5 |
| QAS | — | 0.8 | — | — | — | — |
| QAS1 | — | — | — | 0.8 | 0.5 | 1.0 |
| Zeolite A | 18.1 | 18.0 | 14.1 | 18.1 | 20.0 | 18.1 |
| Citric | — | — | — | 2.5 | — | 2.5 |
| Carbonate | 13.0 | 13.0 | 27.0 | 10.0 | 10.0 | 13.0 |
| Na-SKS-6 | — | — | — | 10.0 | — | 10.0 |
| Silicate | 1.4 | 1.4 | 3.0 | 0.3 | 0.5 | 0.3 |
| Citrate | — | 1.0 | — | 3.0 | — | — |
| Sulfate | 26.1 | 26.1 | 26.1 | 6.0 | — | — |
| Mg sulfate | 0.3 | — | — | 0.2 | — | 0.2 |
| MA/AA | 0.3 | 0.3 | 0.3 | 4.0 | 1.0 | 1.0 |
| CMC | 0.2 | 0.2 | 0.2 | 0.2 | 0.4 | 0.4 |
| PB4 | 9.0 | 9.0 | 5.0 | — | — | — |
| Percarbonate | — | — | — | — | 18.0 | 18.0 |
| TAED | 1.5 | 0.4 | 1.5 | — | 3.9 | 4.2 |
| NACA-OBS | — | 2.0 | 1.0 | — | — | — |
| DETPMP | 0.25 | 0.25 | 0.25 | 0.25 | — | — |
| SRP 1 | — | — | — | 0.2 | — | 0.2 |
| EDDS | — | 0.25 | 0.4 | — | 0.5 | 0.5 |
| CFAA | — | 1.0 | — | 2.0 | — | — |
| HEDP | 0.3 | 0.3 | 0.3 | 0.3 | 0.4 | 0.4 |
| QEA | — | — | — | 0.2 | — | 0.5 |
| Acid-thiol ligase | 0.03 | 0.03 | — | 0.01 | 0.008 | — |
| Esterification compound | 0.3 | 0.15 | — | 0.1 | 0.08 | — |
| Source of energy | 0.3 | 0.3 | — | 0.12 | 0.08 | — |
| Desaturase | 0.055 | — | 0.05 | 0.1 | 0.12 | — |
| Electron donor system | 0.005 | — | 0.005 | 0.01 | 0.03 | — |
| Gluthatione transferase | — | — | — | — | — | 0.05 |
| Protease | 0.009 | 0.009 | 0.01 | 0.04 | 0.05 | 0.03 |
| Amylase | 0.002 | 0.002 | 0.002 | 0.006 | 0.008 | 0.008 |
| Cellulase | 0.0007 | — | — | 0.0007 | 0.0007 | 0.0007 |
| Lipase | 0.006 | — | — | 0.01 | 0.01 | 0.01 |
| Photoactivated bleach (ppm) | 15 | 15 | 15 | — | 20 | 20 |
| PVNO/PVPVI | — | — | — | 0.1 | — | — |
| Brightener 1 | 0.09 | 0.09 | 0.09 | — | 0.09 | 0.09 |
| Perfume | 0.3 | 0.3 | 0.3 | 0.4 | 0.4 | 0.4 |
| Silicone antifoam | 0.5 | 0.5 | 0.5 | — | 0.3 | 0.3 |
| Density in g/liter | 850 | 850 | 850 | 850 | 850 | 850 |
| Miscellaneous and minors | Up to 100% | | | | | |

-continued

| | I | II | III | IV | V | VI |
|---|---|---|---|---|---|---|
| QAS 1 | — | 0.7 | 1.0 | 0.5 | 1.0 | 0.7 |
| STPP | 19.7 | — | — | — | — | — |
| Zeolite A | — | 19.5 | 25.0 | 19.5 | 20.0 | 17.0 |
| NaSKS-6/ citric acid (79:21) | — | 10.6 | — | 10.6 | — | — |
| Na-SKS-6 | — | — | 9.0 | — | 10.0 | 10.0 |
| Carbonate | 6.1 | 21.4 | 9.0 | 10.0 | 10.0 | 18.0 |
| Bicarbonate | — | 2.0 | 7.0 | 5.0 | — | 2.0 |
| Silicate | 6.8 | — | — | 0.3 | 0.5 | — |
| Citrate | — | — | 4.0 | 4.0 | — | — |
| Sulfate | 39.8 | — | — | 5.0 | — | 12.0 |
| Mg sulfate | — | — | 0.1 | 0.2 | 0.2 | — |
| MA/AA | 0.5 | 1.6 | 3.0 | 4.0 | 1.0 | 1.0 |
| CMC | 0.2 | 0.4 | 1.0 | 1.0 | 0.4 | 0.4 |
| PB4 | 5.0 | 12.7 | — | — | — | — |
| Percarbonate | — | — | — | — | 18.0 | 15.0 |
| TAED | 0.5 | 3.1 | — | — | 5.0 | — |
| NACA-OBS | 1.0 | 3.5 | — | — | — | 2.5 |
| DETPMP | 0.25 | 0.2 | 0.3 | 0.4 | — | 0.2 |
| HEDP | — | 0.3 | — | 0.3 | 0.3 | 0.3 |
| QEA | — | — | 1.0 | 1.0 | 1.0 | — |
| Acid-thiol ligase | 0.03 | 0.05 | — | 0.03 | 0.03 | — |
| Esterification compound | 0.3 | 0.4 | — | 0.25 | 0.3 | — |
| Source of energy | 0.2 | 0.5 | — | 0.3 | 0.3 | — |
| Desaturase | 0.05 | 0.1 | 0.1 | — | — | — |
| Electron donor system | 0.008 | 0.01 | 0.02 | — | — | — |
| Glutathione transferase | — | — | — | 0.05 | 0.05 | 0.1 |
| Protease | 0.009 | 0.03 | 0.03 | 0.05 | 0.05 | 0.02 |
| Lipase | 0.003 | 0.003 | 0.006 | 0.006 | 0.006 | 0.004 |
| Cellulase | 0.0006 | 0.0006 | 0.0005 | 0.0005 | 0.0007 | 0.0007 |
| Amylase | 0.002 | 0.002 | 0.006 | 0.006 | 0.01 | 0.003 |
| PVNO/PVPVI | — | — | 0.2 | 0.2 | — | — |
| PVP | 0.9 | 1.3 | — | — | — | 0.9 |
| SRP 1 | — | — | 0.2 | 0.2 | 0.2 | — |
| Photoactivated bleach (ppm) | 15 | 27 | — | — | 20 | 20 |
| Photoactivated bleach (2) (ppm) | 15 | — | — | — | — | — |
| Brightener 1 | 0.08 | 0.2 | — | — | 0.09 | 0.15 |
| Brightener 2 | — | 0.04 | — | — | — | — |
| Perfume | 0.3 | 0.5 | 0.4 | 0.3 | 0.4 | 0.3 |
| Silicone antifoam | 0.5 | 2.4 | 0.3 | 0.5 | 0.3 | 2.0 |
| Density in g/liter | 750 | 750 | 750 | 750 | 750 | 750 |
| Miscellaneous and minors | Up to 100% | | | | | |

EXAMPLE 2

The following granular laundry detergent compositions of particular utility under European machine wash conditions were prepared according to the present invention:

| | I | II | III | IV | V | VI |
|---|---|---|---|---|---|---|
| LAS | 5.5 | 7.5 | 5.0 | 5.0 | 6.0 | 7.0 |
| TAS | 1.25 | 1.9 | — | 0.8 | 0.4 | 0.3 |
| C24AS/C25AS | — | 2.2 | 5.0 | 5.0 | 5.0 | 2.2 |
| C25E3S | — | 0.8 | 1.0 | 1.5 | 3.0 | 1.0 |
| C45E7 | 3.25 | — | — | — | — | 3.0 |
| TFAA | — | — | 2.0 | — | — | — |
| C25E5 | — | 5.5 | — | — | — | — |
| QAS | 0.8 | — | — | — | — | — |

EXAMPLE 3

The following detergent formulations of particular utility under European machine wash conditions were prepared according to the present invention:

| | I | II | III | IV |
|---|---|---|---|---|
| Blown Powder | | | | |
| LAS | 6.0 | 5.0 | 11.0 | 6.0 |
| TAS | 2.0 | — | — | 2.0 |
| Zeolite A | 24.0 | — | — | 20.0 |
| STPP | — | 27.0 | 24.0 | — |
| Sulfate | 4.0 | 6.0 | 13.0 | — |
| MA/AA | 1.0 | 4.0 | 6.0 | 2.0 |

-continued

| | I | II | III | IV |
|---|---|---|---|---|
| Silicate | 1.0 | 7.0 | 3.0 | 3.0 |
| CMC | 1.0 | 1.0 | 0.5 | 0.6 |
| Brightener 1 | 0.2 | 0.2 | 0.2 | 0.2 |
| Silicone antifoam | 1.0 | 1.0 | 1.0 | 0.3 |
| DETPMP | 0.4 | 0.4 | 0.2 | 0.4 |
| Spray On | | | | |
| Brightener | 0.02 | — | — | 0.02 |
| C45E7 | — | — | — | 5.0 |
| C45E2 | 2.5 | 2.5 | 2.0 | — |
| C45E3 | 2.6 | 2.5 | 2.0 | — |
| Perfume | 0.5 | 0.3 | 0.5 | 0.2 |
| Silicone antifoam | 0.3 | 0.3 | 0.3 | — |
| Dry additives | | | | |
| QEA | — | — | — | 1.0 |
| EDDS | 0.3 | — | — | — |
| Sulfate | 2.0 | 3.0 | 5.0 | 10.0 |
| Carbonate | 6.0 | 13.0 | 15.0 | 14.0 |
| Citric | 2.5 | — | — | 2.0 |
| QAS 1 | 0.5 | — | — | 0.5 |
| Na-SKS-6 | 10.0 | — | — | — |
| Percarbonate | 18.5 | — | — | — |
| PB4 | — | 18.0 | 10.0 | 21.5 |
| TAED | 2.0 | 2.0 | — | 2.0 |
| NACA-OBS | 3.0 | 2.0 | 4.0 | — |
| Acid-thiol ligase | 0.02 | 0.03 | — | — |
| Esterification compound | 0.15 | 0.3 | — | — |
| Source of energy | 0.2 | 0.3 | — | — |
| Desaturase | 0.05 | 0.05 | 0.05 | — |
| Electron donor system | 0.005 | 0.005 | 0.006 | — |
| Glutathione transferase | — | — | — | 0.05 |
| Protease | 0.03 | 0.03 | 0.03 | 0.03 |
| Lipase | 0.008 | 0.008 | 0.008 | 0.004 |
| Amylase | 0.003 | 0.003 | 0.003 | 0.006 |
| Brightener 1 | 0.05 | — | — | 0.05 |
| Miscellaneous and minors | | Up to 100% | | |

EXAMPLE 4

The following granular detergent formulations were prepared according to the present invention:

| | I | II | III | IV | V | VI |
|---|---|---|---|---|---|---|
| Blown Powder | | | | | | |
| LAS | 23.0 | 8.0 | 7.0 | 9.0 | 7.0 | 7.0 |
| TAS | — | — | — | — | 1.0 | — |
| C45AS | 6.0 | 6.0 | 5.0 | 8.0 | — | — |
| C45AES | — | 1.0 | 1.0 | 1.0 | — | — |
| C45E35 | — | — | — | — | 2.0 | 4.0 |
| Zeolite A | 10.0 | 18.0 | 14.0 | 12.0 | 10.0 | 10.0 |
| MA/AA | — | 0.5 | — | — | — | 2.0 |
| MA/AA 1 | 7.0 | — | — | — | — | — |
| AA | — | 3.0 | 3.0 | 2.0 | 3.0 | 3.0 |
| Sulfate | 5.0 | 6.3 | 14.3 | 11.0 | 15.0 | 19.3 |
| Silicate | 10.0 | 1.0 | 1.0 | 1.0 | 1.0 | 1.0 |
| Carbonate | 15.0 | 20.0 | 10.0 | 20.7 | 8.0 | 6.0 |
| PEG 4000 | 0.4 | 1.5 | 1.5 | 1.0 | 1.0 | 1.0 |
| DTPA | — | 0.9 | 0.5 | — | — | 0.5 |
| Brightener 2 | 0.3 | 0.2 | 0.3 | — | 0.1 | 0.3 |
| Spray On | | | | | | |
| C45E7 | — | 2.0 | — | — | 2.0 | 2.0 |
| C25E9 | 3.0 | — | — | — | — | — |
| C23E9 | — | — | 1.5 | 2.0 | — | 2.0 |
| Perfume | 0.3 | 0.3 | 0.3 | 2.0 | 0.3 | 0.3 |
| Agglomerates | | | | | | |
| C45AS | — | 5.0 | 5.0 | 2.0 | — | 5.0 |
| LAS | — | 2.0 | 2.0 | — | — | 2.0 |

-continued

| | I | II | III | IV | V | VI |
|---|---|---|---|---|---|---|
| Zeolite A | — | 7.5 | 7.5 | 8.0 | — | 7.5 |
| Carbonate | — | 4.0 | 4.0 | 5.0 | — | 4.0 |
| PEG 4000 | — | 0.5 | 0.5 | — | — | 0.5 |
| Misc (Water etc.) | — | 2.0 | 2.0 | 2.0 | — | 2.0 |
| Dry additives | | | | | | |
| QAS | — | — | — | — | 1.0 | — |
| Citric | — | — | — | — | 2.0 | — |
| PB4 | — | — | — | — | 12.0 | 1.0 |
| PB1 | 4.0 | 1.0 | 3.0 | 2.0 | — | — |
| Percarbonate | — | — | — | — | 2.0 | 10.0 |
| Carbonate | — | 5.3 | 1.8 | — | 4.0 | 4.0 |
| NOBS | 4.0 | — | 6.0 | — | — | 0.6 |
| Methyl cellulose | 0.2 | — | — | — | — | — |
| Na-SKS-6 | 8.0 | — | — | — | — | — |
| STS | — | — | 2.0 | — | 1.0 | — |
| Culmene sulfonic acid | — | 1.0 | — | — | — | 2.0 |
| Acid-thiol ligase | 0.05 | — | 0.03 | — | 0.03 | — |
| Esterification compound | 0.4 | — | 0.3 | — | 0.3 | — |
| Source of energy | 0.5 | — | 0.32 | — | 0.3 | — |
| Desaturase | — | 0.05 | 0.1 | 0.1 | — | — |
| Electron donor system | — | 0.006 | 0.009 | 0.01 | — | — |
| Glutathione transferase | — | — | — | 0.005 | — | 0.05 |
| Protease | 0.02 | 0.02 | 0.02 | 0.01 | 0.02 | 0.02 |
| Lipase | 0.004 | — | 0.004 | — | 0.004 | 0.008 |
| Amylase | 0.003 | — | 0.002 | — | 0.003 | — |
| Cellulase | 0.0005 | 0.0005 | 0.0005 | 0.0007 | 0.0005 | 0.0005 |
| PVPVI | — | — | — | — | 0.5 | 0.1 |
| PVP | — | — | — | — | 0.5 | — |
| PVNO | — | — | 0.5 | 0.3 | — | — |
| QEA | — | — | — | — | 1.0 | — |
| SRP 1 | 0.2 | 0.5 | 0.3 | — | 0.2 | — |
| Silicone antifoam | 0.2 | 0.4 | 0.2 | 0.4 | 0.1 | — |
| Mg sulfate | — | — | 0.2 | — | 0.2 | — |
| Miscellaneous and minors | | | Up to 100% | | | |

EXAMPLE 5

The following nil bleach-containing detergent formulations of particular use in the washing of coloured clothing were prepared according to the present invention:

| | I | II | III | IV | V | VI |
|---|---|---|---|---|---|---|
| Blown Powder | | | | | | |
| Zeolite A | 15.0 | 15.0 | — | 15.0 | 15.0 | — |
| Sulfate | — | 5.0 | — | — | 5.0 | — |
| LAS | 3.0 | 3.0 | — | 3.0 | 3.0 | — |
| DETPMP | 0.4 | 0.5 | — | 0.4 | 0.5 | — |
| CMC | 0.4 | 0.4 | — | 0.4 | 0.4 | — |
| MA/AA | 4.0 | 4.0 | — | 4.0 | 4.0 | — |
| Agglomerates | | | | | | |
| C45AS | — | — | 11.0 | — | — | 11.0 |
| LAS | 6.0 | 5.0 | — | 6.0 | 5.0 | — |
| TAS | 3.0 | 2.0 | — | 3.0 | 2.0 | — |
| Silicate | 4.0 | 4.0 | — | 4.0 | 4.0 | — |
| Zeolite A | 10.0 | 15.0 | 13.0 | 10.0 | 15.0 | 13.0 |
| CMC | — | — | 0.5 | — | — | 0.5 |

-continued

| | I | II | III | IV | V | VI |
|---|---|---|---|---|---|---|
| MA/AA | — | — | 2.0 | — | — | 2.0 |
| Carbonate | 9.0 | 7.0 | 7.0 | 9.0 | 7.0 | 7.0 |
| Spray-on | | | | | | |
| Perfume | 0.3 | 0.3 | 0.5 | 0.3 | 0.3 | 0.5 |
| C45E7 | 4.0 | 4.0 | 4.0 | 4.0 | 4.0 | 4.0 |
| C25E3 | 2.0 | 2.0 | 2.0 | 2.0 | 2.0 | 2.0 |
| Dry additives | | | | | | |
| MA/AA | — | — | 3.0 | — | — | 3.0 |
| Na-SKS-6 | — | — | 12.0 | — | — | 12.0 |
| Citrate | 10.0 | — | 8.0 | 10.0 | — | 8.0 |
| Bicarbonate | 7.0 | 3.0 | 5.0 | 7.0 | 3.0 | 5.0 |
| Carbonate | 8.0 | 5.0 | 7.0 | 8.0 | 5.0 | 7.0 |
| PVPVI/PVNO | 0.5 | 0.5 | 0.5 | 0.5 | 0.5 | 0.5 |
| Acid-thiol ligase | 0.3 | 0.05 | — | 0.01 | — | — |
| Esterification compound | 2.25 | 0.5 | — | 0.1 | — | — |
| Source of energy | 1.5 | 0.38 | — | 0.1 | — | — |
| Desaturase | — | 0.1 | 0.05 | 0.01 | — | — |
| Electron donor system | — | 0.01 | 0.007 | 0.001 | — | — |
| Glutathione transferase | — | — | — | — | 0.0009 | 0.5 |
| Protease | 0.03 | 0.02 | 0.05 | 0.03 | 0.02 | 0.05 |
| Lipase | 0.008 | 0.008 | 0.008 | 0.008 | 0.008 | 0.008 |
| Amylase | 0.01 | 0.01 | 0.01 | 0.01 | 0.01 | 0.01 |
| Cellulase | 0.001 | 0.001 | 0.001 | 0.001 | 0.001 | 0.001 |
| Silicone antifoam | 5.0 | 5.0 | 5.0 | 5.0 | 5.0 | 5.0 |
| Sulfate | — | 9.0 | — | — | 9.0 | — |
| Density (g/liter) | 700 | 700 | 700 | 700 | 700 | 700 |
| Miscellaneous and minors | Up to 100% | | | | | |

EXAMPLE 6

The following detergent formulations were prepared according to the present invention:

| | I | II | III | IV | V | VI |
|---|---|---|---|---|---|---|
| Base granule | | | | | | |
| Zeolite A | 30.0 | 22.0 | 24.0 | 10.0 | 30.0 | 22.0 |
| Sulfate | 10.0 | 5.0 | 10.0 | 7.0 | 10.0 | 5.0 |
| MA/AA | 3.0 | — | — | — | 3.0 | — |
| M | — | 1.6 | 2.0 | — | — | 1.6 |
| MA/AA 1 | — | 12.0 | — | 6.0 | — | 12.0 |
| LAS | 14.0 | 10.0 | 9.0 | 20.0 | 14.0 | 10.0 |
| C45AS | 8.0 | 7.0 | 9.0 | 7.0 | 8.0 | 7.0 |
| C45AES | — | 1.0 | 1.0 | — | — | 1.0 |
| Silicate | — | 1.0 | 0.5 | 10.0 | — | 1.0 |
| Soap | — | 2.0 | — | — | — | 2.0 |
| Brightener 1 | 0.2 | 0.2 | 0.2 | 0.2 | 0.2 | 0.2 |
| Carbonate | 6.0 | 9.0 | 10.0 | 10.0 | 6.0 | 9.0 |
| PEG 4000 | — | 1.0 | 1.5 | — | — | 1.0 |
| DTPA | — | 0.4 | — | — | — | 0.4 |
| Spray On | | | | | | |
| C25E9 | — | — | — | 5.0 | — | |
| C45E7 | 1.0 | 1.0 | — | — | 1.0 | 1.0 |
| C23E9 | — | 1.0 | 2.5 | — | — | 1.0 |
| Perfume | 0.2 | 0.3 | 0.3 | — | 0.2 | 0.3 |
| Dry additives | | | | | | |
| Carbonate | 5.0 | 10.0 | 18.0 | 8.0 | 5.0 | 10.0 |
| PVPVI/PVNO | 0.5 | — | 0.3 | — | 0.5 | — |
| Acid-thiol ligase | 0.05 | 0.1 | 0.03 | 0.009 | — | 0.05 |
| Esterification compound | 0.4 | 1.0 | 0.3 | 0.1 | — | 0.5 |
| Source of energy | 0.5 | 0.8 | 0.3 | 0.09 | — | 0.5 |

-continued

| | I | II | III | IV | V | VI |
|---|---|---|---|---|---|---|
| Desaturase | 0.05 | 0.1 | 0.03 | 0.1 | — | — |
| Electron donor sytem | 0.005 | 0.01 | 0.005 | 0.02 | — | — |
| Glutathione transferase | — | — | — | — | 0.05 | 0.001 |
| Protease | 0.03 | 0.03 | 0.03 | 0.02 | 0.03 | 0.03 |
| Lipase | 0.008 | — | — | 0.008 | 0.008 | — |
| Amylase | 0.002 | — | — | 0.002 | 0.002 | — |
| Cellulase | 0.0002 | 0.0005 | 0.0005 | 0.0002 | 0.0002 | 0.0005 |
| NOBS | — | 4.0 | — | 4.5 | — | 4.0 |
| PB1 | 1.0 | 5.0 | 1.5 | 6.0 | 1.0 | 5.0 |
| Sulfate | 4.0 | 5.0 | — | 5.0 | 4.0 | 5.0 |
| SRP 1 | — | 0.4 | — | — | — | 0.4 |
| Suds suppressor | — | 0.5 | 0.5 | — | — | 0.5 |
| Miscellaneous and minors | Up to 100% | | | | | |

EXAMPLE 7

The following granular detergent formulations were prepared according to the present invention:

| | I | II | III | IV | V | VI |
|---|---|---|---|---|---|---|
| Blown Powder | | | | | | |
| Zeolite A | 20.0 | — | 15.0 | 20.0 | — | 15.0 |
| STPP | — | 20.0 | — | — | 20.0 | — |
| Sodium sulfate | — | — | 5.0 | — | — | 5.0 |
| Carbonate | — | — | 5.0 | — | — | 5.0 |
| TAS | — | — | 1.0 | — | — | 1.0 |
| LAS | 6.0 | 6.0 | 6.0 | 6.0 | 6.0 | 6.0 |
| C68AS | 2.0 | 2.0 | — | 2.0 | 2.0 | — |
| Silicate | 3.0 | 8.0 | — | 3.0 | 8.0 | — |
| MA/AA | 4.0 | 2.0 | 2.0 | 4.0 | 2.0 | 2.0 |
| CMC | 0.6 | 0.6 | 0.2 | 0.6 | 0.6 | 0.2 |
| Brightener 1 | 0.2 | 0.2 | 0.1 | 0.2 | 0.2 | 0.1 |
| DETPMP | 0.4 | 0.4 | 0.1 | 0.4 | 0.4 | 0.1 |
| STS | — | — | 1.0 | — | — | 1.0 |
| Spray On | | | | | | |
| C45E7 | 5.0 | 5.0 | 4.0 | 5.0 | 5.0 | 4.0 |
| Silicone antifoam | 0.3 | 0.3 | 0.1 | 0.3 | 0.3 | 0.1 |
| Perfume | 0.2 | 0.2 | 0.3 | 0.2 | 0.2 | 0.3 |
| Dry additives | | | | | | |
| QEA | — | — | 1.0 | — | — | 1.0 |
| Carbonate | 14.0 | 9.0 | 10.0 | 14.0 | 9.0 | 10.0 |
| PB1 | 1.5 | 2.0 | — | 1.5 | 2.0 | — |
| PB4 | 18.5 | 13.0 | 13.0 | 18.5 | 13.0 | 13.0 |
| TAED | 2.0 | 2.0 | 2.0 | 2.0 | 2.0 | 2.0 |
| QAS | — | — | 1.0 | — | — | 1.0 |
| Photoactivated bleach | 15 ppm | 15 ppm | 15 ppm | 15 ppm | 15 ppm | 15 ppm |
| Na-SKS-6 | — | — | 3.0 | — | — | 3.0 |
| Acid-thiol ligase | — | 0.05 | 0.03 | 0.03 | — | — |
| Esterification compound | — | 0.5 | 0.3 | 0.2 | — | — |
| Source of energy | — | 0.4 | 0.3 | 0.3 | — | — |
| Desaturase | 0.1 | — | 0.5 | — | — | 0.01 |
| Electron donor system | 0.015 | — | 0.05 | — | — | 0.002 |
| Gluthathione transferase | — | — | — | — | 0.08 | 0.01 |
| Protease | 0.03 | 0.03 | 0.007 | 0.03 | 0.03 | 0.007 |
| Lipase | 0.004 | 0.004 | 0.004 | 0.004 | 0.004 | 0.004 |
| Amylase | 0.006 | 0.006 | 0.003 | 0.006 | 0.006 | 0.003 |
| Cellulase | 0.0002 | 0.0002 | 0.0005 | 0.0002 | 0.0002 | 0.0005 |

-continued

| | I | II | III | IV | V | VI |
|---|---|---|---|---|---|---|
| Sulfate | 10.0 | 20.0 | 5.0 | 10.0 | 20.0 | 5.0 |
| Density (g/liter) | 700 | 700 | 700 | 700 | 700 | 700 |
| Miscellaneous and minors | | | Up to 100% | | | |

EXAMPLE 8

The following detergent formulations were prepared according to the present invention:

| | I | II | III |
|---|---|---|---|
| Blown Powder | | | |
| Zeolite A | 15.0 | 15.0 | 15.0 |
| Sulfate | — | 5.0 | — |
| LAS | 3.0 | 3.0 | 3.0 |
| QAS | — | 1.5 | 1.5 |
| DETPMP | 0.4 | 0.2 | 0.4 |
| EDDS | — | 0.4 | 0.2 |
| CMC | 0.4 | 0.4 | 0.4 |
| MA/AA | 4.0 | 2.0 | 2.0 |
| Agglomerate | | | |
| LAS | 5.0 | 5.0 | 5.0 |
| TAS | 2.0 | 2.0 | 1.0 |
| Silicate | 3.0 | 3.0 | 4.0 |
| Zeolite A | 8.0 | 8.0 | 8.0 |
| Carbonate | 8.0 | 8.0 | 4.0 |
| Spray On | | | |
| Perfume | 0.3 | 0.3 | 0.3 |
| C45E7 | 2.0 | 2.0 | 2.0 |
| C25E3 | 2.0 | — | — |
| Dry Additives | | | |
| Citrate | 5.0 | — | 2.0 |
| Bicarbonate | — | 3.0 | — |
| Carbonate | 8.0 | 15.0 | 10.0 |
| TAED | 6.0 | 2.0 | 5.0 |
| PB1 | 14.0 | 7.0 | 10.0 |
| PEO | — | — | 0.2 |
| Bentonite clay | — | — | 10.0 |
| Acid-thiol ligase | 0.05 | 0.1 | — |
| Esterification compound | 0.5 | 1.0 | — |
| Source of energy | 0.5 | 1.0 | — |
| Desaturase | 0.05 | 0.5 | — |
| Electron donor system | 0.005 | 0.5 | — |
| Glutathione transferase | — | — | 0.05 |
| Protease | 0.03 | 0.03 | 0.03 |
| Lipase | 0.008 | 0.008 | 0.008 |
| Cellulase | 0.001 | 0.001 | 0.001 |
| Amylase | 0.01 | 0.01 | 0.01 |
| Silicone antifoam | 5.0 | 5.0 | 5.0 |
| Sulfate | — | 3.0 | — |
| Density (g/liter) | 850 | 850 | 850 |
| Miscellaneous and minors | | Up to 100% | |

EXAMPLE 9

The following detergent formulations were prepared according to the present invention:

| | I | II | III | IV | V | VI |
|---|---|---|---|---|---|---|
| LAS | 18.0 | 14.0 | 24.0 | 20.0 | 18.0 | 14.0 |
| QAS | 0.7 | 1.0 | — | 0.7 | 0.7 | 1.0 |

-continued

| | I | II | III | IV | V | VI |
|---|---|---|---|---|---|---|
| TFAA | — | 1.0 | — | — | — | 1.0 |
| C23E56.5 | — | — | 1.0 | — | — | — |
| C45E7 | — | 1.0 | — | — | — | 1.0 |
| C45E3S | 1.0 | 2.5 | 1.0 | — | 1.0 | 2.5 |
| STPP | 32.0 | 18.0 | 30.0 | 22.0 | 32.0 | 18.0 |
| Silicate | 9.0 | 5.0 | 9.0 | 8.0 | 9.0 | 5.0 |
| Carbonate | 11.0 | 7.5 | 10.0 | 5.0 | 11.0 | 7.5 |
| Bicarbonate | — | 7.5 | — | — | — | 7.5 |
| PB1 | 3.0 | 1.0 | — | — | 3.0 | 1.0 |
| PB4 | — | 1.0 | — | — | — | 1.0 |
| NOBS | 2.0 | 1.0 | — | — | 2.0 | 1.0 |
| DETPMP | — | 1.0 | — | — | 1.0 | |
| DTPA | 0.5 | — | 0.2 | 0.3 | 0.5 | — |
| SRP 1 | 0.3 | 0.2 | — | 0.1 | 0.3 | 0.2 |
| MA/AA | 1.0 | 1.5 | 2.0 | 0.5 | 1.0 | 1.5 |
| CMC | 0.8 | 0.4 | 0.4 | 0.2 | 0.8 | 0.4 |
| PEI | — | — | 0.4 | — | — | — |
| Sulfate | 20.0 | 10.0 | 20.0 | 30.0 | 20.0 | 10.0 |
| Mg sulfate | 0.2 | — | 0.4 | 0.9 | 0.2 | — |
| Acid-thiol ligase | 0.05 | — | 0.2 | 0.05 | 0.1 | — |
| Esterification compound | 0.5 | — | 1.5 | 0.4 | 1.0 | — |
| Source of energy | 0.5 | — | 2.0 | 0.5 | 0.8 | — |
| Desaturase | 0.05 | 0.05 | — | 0.05 | 0.1 | — |
| Electron donor system | 0.005 | 0.01 | — | 0.005 | 0.01 | — |
| Glutathione transferase | 0.05 | — | — | — | — | 0.05 |
| Protease | 0.03 | 0.03 | 0.02 | 0.02 | 0.03 | 0.03 |
| Amylase | 0.008 | 0.007 | — | 0.004 | 0.008 | 0.007 |
| Lipase | 0.004 | — | 0.002 | — | 0.004 | — |
| Cellusase | 0.0003 | — | — | 0.0001 | 0.0003 | — |
| Photoactivated bleach | 30 ppm | 20 ppm | — | 10 ppm | 30 ppm | 20 ppm |
| Perfume | 0.3 | 0.3 | 0.1 | 0.2 | 0.3 | 0.3 |
| Brightener ½ | 0.05 | 0.02 | 0.08 | 0.1 | 0.05 | 0.02 |
| Miscellaneous and Minors | | | up to 100% | | | |

EXAMPLE 10

The following liquid detergent formulations were prepared according to the present invention (Levels are given in parts per weight):

| | I | II | III | IV | V |
|---|---|---|---|---|---|
| LAS | 11.5 | 8.8 | — | 3.9 | — |
| C25E2.5S | — | 3.0 | 18.0 | — | 16.0 |
| C45E2.25S | 11.5 | 3.0 | — | 15.7 | — |
| C23E9 | — | 2.7 | 1.8 | 2.0 | 1.0 |
| C23E7 | 3.2 | — | — | — | — |
| CFAA | — | — | 5.2 | — | 3.1 |
| TPKFA | 1.6 | — | 2.0 | 0.5 | 2.0 |
| Citric (50%) | 6.5 | 1.2 | 2.5 | 4.4 | 2.5 |
| Ca formate | 0.1 | 0.06 | 0.1 | — | — |
| Na formate | 0.5 | 0.06 | 0.1 | 0.05 | 0.05 |
| SCS | 4.0 | 1.0 | 3.0 | 1.2 | — |
| Borate | 0.6 | — | 3.0 | 2.0 | 2.9 |
| Na hydroxide | 5.8 | 2.0 | 3.5 | 3.7 | 2.7 |
| Ethanol | 1.75 | 1.0 | 3.6 | 4.2 | 2.9 |
| 1,2 Propanediol | 3.3 | 2.0 | 8.0 | 7.9 | 5.3 |
| Monoethanolamine | 3.0 | 1.5 | 1.3 | 2.5 | 0.8 |
| TEPAE | 1.6 | — | 1.3 | 1.2 | 1.2 |
| Acid-thiol ligase | 0.03 | 0.03 | — | 0.003 | — |
| Esterification compound | 0.2 | 0.3 | — | 0.03 | — |
| Source of energy | 0.3 | 0.25 | — | 0.03 | — |
| Desaturase | — | — | 0.06 | 0.05 | — |
| Electron donor system | — | — | 0.008 | 0.005 | — |
| Glutathione transferase | 0.01 | — | — | — | 0.05 |
| Protease | 0.03 | 0.01 | 0.03 | 0.02 | 0.02 |

-continued

| | I | II | III | IV | V |
|---|---|---|---|---|---|
| Lipase | — | — | 0.002 | — | — |
| Amylase | — | — | — | 0.002 | — |
| Cellulase | — | — | 0.0002 | 0.0005 | 0.0001 |
| SRP 1 | 0.2 | — | 0.1 | — | |
| DTPA | — | — | 0.3 | — | — |
| PVNO | — | — | 0.3 | — | 0.2 |
| Brightener 1 | 0.2 | 0.07 | 0.1 | — | — |
| Silicone antifoam | 0.04 | 0.02 | 0.1 | 0.1 | 0.1 |
| Miscellaneous and water | | | up to 100% | | |

EXAMPLE 11

The following liquid detergent formulations were prepared according to the present invention (Levels are given in parts per weight):

| | I | II | III | IV |
|---|---|---|---|---|
| LAS | 10.0 | 13.0 | 9.0 | — |
| C25AS | 4.0 | 1.0 | 2.0 | 10.0 |
| C25E3S | 1.0 | — | — | 3.0 |
| C25E7 | 6.0 | 8.0 | 13.0 | 2.5 |
| TFAA | — | — | — | 4.5 |
| APA | — | 1.4 | — | — |
| TPKFA | 2.0 | — | 13.0 | 7.0 |
| Citric | 2.0 | 3.0 | 1.0 | 1.5 |
| Dodecenyl/tetradecenyl succinic acid | 12.0 | 10.0 | — | — |
| Rapeseed fatty acid | 4.0 | 2.0 | 1.0 | — |
| Ethanol | 4.0 | 4.0 | 7.0 | 2.0 |
| 1,2 Propanediol | 4.0 | 4.0 | 2.0 | 7.0 |
| Monoethanolamine | — | — | — | 5.0 |
| Triethanolamine | — | — | 8.0 | — |
| TEPAE | 0.5 | — | 0.5 | 0.2 |
| DETPMP | 1.0 | 1.0 | 0.5 | 1.0 |
| Acid-thiol ligase | 0.03 | 0.3 | 0.04 | — |
| Esterification compound | 0.3 | 3.0 | 0.4 | — |
| Source of energy | 0.3 | 3.0 | 0.3 | — |
| Desaturase | 0.05 | — | — | — |
| Electron donor system | 0.005 | — | — | — |
| Gluthatione transferase | — | — | — | 0.12 |
| Protease | 0.02 | 0.02 | 0.01 | 0.008 |
| Lipase | — | 0.002 | — | 0.002 |
| Amylase | 0.004 | 0.004 | 0.01 | 0.008 |
| Cellulase | — | — | — | 0.002 |
| SRP 2 | 0.3 | — | 0.3 | 0.1 |
| Boric acid | 0.1 | 0.2 | 1.0 | 2.0 |
| Ca chloride | — | 0.02 | — | 0.01 |
| Brightener 1 | — | 0.4 | — | — |
| Suds suppressor | 0.1 | 0.3 | — | 0.1 |
| Opacifier | 0.5 | 0.4 | — | 0.3 |
| NaOH up to pH | 8.0 | 8.0 | 7.6 | 7.7 |
| Miscellaneous and water | | | Up to 100% | |

EXAMPLE 12

The following liquid detergent formulations were prepared according to the present invention (Levels are given in parts per weight):

| | I | II | III | IV |
|---|---|---|---|---|
| LAS | 25.0 | — | — | — |
| C25AS | — | 13.0 | 18.0 | 15.0 |
| C25E3S | — | 2.0 | 2.0 | 4.0 |
| C25E7 | — | — | 4.0 | 4.0 |

-continued

| | I | II | III | IV |
|---|---|---|---|---|
| TFAA | — | 6.0 | 8.0 | 8.0 |
| APA | 3.0 | 1.0 | 2.0 | — |
| TPKFA | — | 15.0 | 11.0 | 11.0 |
| Citric | 1.0 | 1.0 | 1.0 | 1.0 |
| Dodecenyl/tetradecenyl succinic acid | 15.0 | — | — | — |
| Rapeseed fatty acid | 1.0 | — | 3.5 | — |
| Ethanol | 7.0 | 2.0 | 3.0 | 2.0 |
| 1,2 Propanediol | 6.0 | 8.0 | 10.0 | 13.0 |
| Monoethanolamine | — | — | 9.0 | 9.0 |
| TEPAE | — | — | 0.4 | 0.3 |
| DETPMP | 2.0 | 1.2 | 1.0 | — |
| Acid thiol ligase | 0.03 | — | — | 0.005 |
| Esterification compound | 0.2 | — | — | 0.05 |
| Source of energy | 0.2 | — | — | 0.05 |
| Desaturase | — | 0.05 | — | 0.005 |
| Electron donor system | — | 0.005 | — | 0.001 |
| Glutathione transferase | — | 0.05 | 0.05 | — |
| Protease | 0.08 | 0.02 | 0.01 | 0.02 |
| Lipase | — | — | 0.003 | 0.003 |
| Amylase | 0.004 | 0.01 | 0.01 | 0.01 |
| Cellulase | — | — | 0.004 | 0.003 |
| SRP 2 | — | — | 0.2 | 0.1 |
| Boric acid | 1.0 | 1.5 | 2.5 | 2.5 |
| Bentonite clay | 4.0 | 4.0 | — | — |
| Brightener 1 | 0.1 | 0.2 | 0.3 | — |
| Suds suppressor | 0.4 | — | — | — |
| Opacifier | 0.8 | 0.7 | — | — |
| NaOH up to pH | 8.0 | 7.5 | 8.0 | 8.2 |
| Miscellaneous and water | | | Up to 100% | |

EXAMPLE 13

The following liquid detergent compositions were prepared according to the present invention (Levels are given in parts by weight):

| | I | II |
|---|---|---|
| LAS | 27.6 | 18.9 |
| C45AS | 13.8 | 5.9 |
| C13E8 | 3.0 | 3.1 |
| Oleic acid | 3.4 | 2.5 |
| Citric | 5.4 | 5.4 |
| Na hydroxide | 0.4 | 3.6 |
| Ca Formate | 0.2 | 0.1 |
| Na Formate | — | 0.5 |
| Ethanol | 7.0 | — |
| Monoethanolamine | 16.5 | 8.0 |
| 1,2 propanediol | 5.9 | 5.5 |
| Xylene sulfonic acid | — | 2.4 |
| TEPAE | 1.5 | 0.8 |
| Protease | 0.05 | 0.02 |
| Acid-thiol ligase | 0.05 | — |
| Esterification compound | 0.4 | — |
| Source of energy | 0.4 | — |
| Desaturase | 0.05 | — |
| Electron donor system | 0.05 | — |
| Glutathione transferase | — | 0.05 |
| PEG | — | 0.7 |
| Brightener 2 | 0.4 | 0.1 |
| Perfume | 0.5 | 0.3 |
| Miscellaneous and water | Up to 100% | |

EXAMPLE 14

The following granular fabric detergent compositions which provide "softening through the wash" capability were prepared according to the present invention:

| | I | II | III | IV |
|---|---|---|---|---|
| C45AS | — | 10.0 | — | 10.0 |
| LAS | 7.6 | — | 7.6 | — |
| C6SAS | 1.3 | — | 1.3 | — |
| C45E7 | 4.0 | — | 4.0 | — |
| C25E3 | — | 5.0 | — | 5.0 |
| Coco-alkyl-dimethyl hydroxy-ethyl ammonium chloride | 1.4 | 1.0 | 1.4 | 1.0 |
| Citrate | 5.0 | 3.0 | 5.0 | 3.0 |
| Na-SKS-6 | — | 11.0 | — | 11.0 |
| Zeolite A | 15.0 | 15.0 | 15.0 | 15.0 |
| MA/AA | 4.0 | 4.0 | 4.0 | 4.0 |
| DETPMP | 0.4 | 0.4 | 0.4 | 0.4 |
| PB1 | 15.0 | — | 15.0 | — |
| Percarbonate | — | 15.0 | — | 15.0 |
| TAED | 5.0 | 5.0 | 5.0 | 5.0 |
| Smectite clay | 10.0 | 10.0 | 10.0 | 10.0 |
| HMWPEO | — | 0.1 | — | 0.1 |
| Acid-thiol ligase | — | — | 0.05 | 0.5 |
| Esterification compound | — | — | 0.5 | 5.1 |
| Source of energy | — | — | 0.5 | 4.0 |
| Desaturase | 0.1 | — | 0.05 | 0.1 |
| Electron donor system | 0.01 | — | 0.05 | 0.15 |
| Glutathione transferase | 0.01 | 0.01 | — | — |
| Protease | 0.02 | 0.01 | 0.02 | 0.01 |
| Lipase | 0.02 | 0.01 | 0.02 | 0.01 |
| Amylase | 0.03 | 0.005 | 0.03 | 0.005 |
| Cellulase | 0.001 | — | 0.001 | — |
| Silicate | 3.0 | 5.0 | 3.0 | 5.0 |
| Carbonate | 10.0 | 10.0 | 10.0 | 10.0 |
| Suds suppressor | 1.0 | 4.0 | 1.0 | 4.0 |
| CMC | 0.2 | 0.1 | 0.2 | 0.1 |
| Water and Minors | | Up to 100% | | |

EXAMPLE 15

The following rinse added fabric softener compositions were prepared according to the present invention:

| | I | II | III | IV |
|---|---|---|---|---|
| DEQA (2) | 20.0 | 20.0 | 20.0 | 20.0 |
| Acid-thiol ligase | 0.05 | 0.03 | — | — |
| Esterification compound | 0.5 | 0.2 | — | — |
| Source of energy | 0.5 | 0.3 | — | — |
| Desaturase | 0.05 | 0.03 | — | 0.5 |
| Electron donor system | 0.005 | 0.003 | — | 0.1 |
| Glutathione transferase | — | — | 0.5 | — |
| Cellulase | 0.001 | 0.001 | 0.001 | 0.001 |
| HCL | 0.03 | 0.03 | 0.03 | 0.03 |
| Antifoam agent | 0.01 | 0.01 | 0.01 | 0.01 |
| Blue dye | 25 ppm | 25 ppm | 25 ppm | 25 ppm |
| $CaCl_2$ | 0.20 | 0.20 | 0.20 | 0.20 |
| Perfume | 0.90 | 0.90 | 0.90 | 0.90 |
| Miscellaneous and water | | Up to 100% | | |

EXAMPLE 16

The following fabric softener and dryer added fabric conditioner compositions were prepared according to the present invention:

| | I | II | III | IV | V |
|---|---|---|---|---|---|
| DEQA | 2.6 | 19.0 | — | — | — |
| DEQA(2) | — | — | — | — | 51.8 |
| DTMAMS | — | — | — | 26.0 | — |
| SDASA | — | — | 70.0 | 42.0 | 40.2 |

-continued

| | I | II | III | IV | V |
|---|---|---|---|---|---|
| Stearic acid of IV = 0 | 0.3 | — | — | — | — |
| Neodol 45-13 | — | — | 13.0 | — | — |
| Hydrochloride acid | 0.02 | 0.02 | — | — | — |
| Ethanol | — | — | 1.0 | — | — |
| Acid-thiol ligase | — | 0.2 | 0.05 | 0.005 | 0.1 |
| Esterification compound | — | 2.0 | 0.5 | 0.05 | 0.8 |
| Source of energy | 0.5 | 1.75 | 0.5 | 0.05 | 0.8 |
| Desaturase | — | 0.01 | 0.5 | 0.1 | — |
| Electron donor system | — | 0.002 | 0.04 | 0.01 | — |
| Glutathione transferase | 0.1 | — | — | — | — |
| Perfume | 1.0 | 1.0 | 0.75 | 1.0 | 1.5 |
| Glycoperse S-20 | — | — | — | — | 15.4 |
| Glycerol monostearate | — | — | — | 26.0 | — |
| Digeranyl Succinate | — | — | 0.38 | — | — |
| Silicone antifoam | 0.01 | 0.01 | — | — | — |
| Electrolyte | — | 0.1 | — | — | — |
| Clay | — | — | — | 3.0 | — |
| Dye | 10 ppm | 25 ppm | 0.01 | — | — |
| Water and minors | 100% | 100% | — | — | — |

EXAMPLE 17

The following laundry bar detergent compositions were prepared according to the present invention:

| | I | II | III | VI | V | III | VI | V |
|---|---|---|---|---|---|---|---|---|
| LAS | — | — | 19.0 | 15.0 | 21.0 | 6.75 | 8.8 | — |
| C28AS | 30.0 | 13.5 | — | — | — | 15.75 | 11.2 | 22.5 |
| Na Laurate | 2.5 | 9.0 | — | — | — | — | — | — |
| Zeolite A | 2.0 | 1.25 | — | — | — | 1.25 | 1.25 | 1.25 |
| Carbonate | 20.0 | 3.0 | 13.0 | 8.0 | 10.0 | 15.0 | 15.0 | 10.0 |
| Ca Carbonate | 27.5 | 39.0 | 35.0 | — | — | 40.0 | — | 40.0 |
| Sulfate | 5.0 | 5.0 | 3.0 | 5.0 | 3.0 | — | — | 5.0 |
| TSPP | 5.0 | — | — | — | — | 5.0 | 2.5 | — |
| STPP | 5.0 | 15.0 | 10.0 | — | — | 7.0 | 8.0 | 10.0 |
| Bentonite clay | — | 10.0 | — | — | 5.0 | — | — | — |
| DETPMP | — | 0.7 | 0.6 | — | 0.6 | 0.7 | 0.7 | 0.7 |
| CMC | — | 1.0 | 1.0 | 1.0 | 1.0 | — | — | 1.0 |
| Talc | — | — | 10.0 | 15.0 | 10.0 | — | — | — |
| Silicate | — | — | 4.0 | 5.0 | 3.0 | — | — | — |
| PVNO | 0.02 | 0.03 | — | 0.01 | — | 0.02 | — | — |
| MNM | 0.4 | 1.0 | — | — | 0.2 | 0.4 | 0.5 | 0.4 |
| SRP 1 | 0.3 | 0.3 | 0.3 | 0.3 | 0.3 | 0.3 | 0.3 | 0.3 |
| Acid-thiol ligase | 0.55 | — | 0.03 | 0.03 | — | — | 0.05 | — |
| Esterification compound | 3.0 | — | 0.3 | 0.23 | — | — | 0.5 | — |
| Source of energey | 4.5 | — | 0.3 | 0.3 | — | — | 0.4 | — |
| Desaturase | — | 0.12 | 0.03 | 0.05 | — | 0.08 | — | — |
| Electron donor system | — | 0.02 | 0.003 | 0.005 | — | 0.01 | — | — |
| Glutathione transferase | 0.5 | — | — | — | 0.5 | 0.08 | — | — |
| Amylase | — | — | 0.01 | — | — | — | 0.002 | — |
| Protease | — | 0.004 | — | 0.003 | 0.003 | — | — | 0.003 |
| Lipase | — | 0.002 | — | 0.002 | — | — | — | — |
| Cellulase | — | .0003 | — | — | .0003 | .0002 | — | — |
| PEO | — | 0.2 | — | 0.2 | 0.3 | — | — | 0.3 |
| Perfume | 1.0 | 0.5 | 0.3 | 0.2 | 0.4 | — | — | 0.4 |
| Mg sulfate | — | — | 3.0 | 3.0 | 3.0 | — | — | — |
| Brightener | 0.15 | 0.1 | 0.15 | — | — | — | — | 0.1 |
| Photoactivated bleach (ppm) | — | 15.0 | 15.0 | 15.0 | 15.0 | — | — | 15.0 |

EXAMPLE 18

The following pre-treatment compositions were prepared in accord with the present invention:

| | I | II | III | IV |
|---|---|---|---|---|
| Bovine serum albumin | 0.05 | 0.05 | 0.05 | — |
| Electron donor system | 0.01 | — | 0.001 | — |
| Acid-thiol ligase | — | 0.005 | 0.005 | — |
| Esterification compound | — | 0.05 | 0.05 | — |
| Source of energy | — | 0.05 | 0.05 | — |
| Desaturase | 0.05 | — | 0.005 | — |
| Glutathione transferase | — | — | — | 0.05 |
| Miscellaneous and water | | Up to 100% | | |

EXAMPLE 19

The following compact high density (0.96 Kg/l) dishwashing detergent compositions were prepared in accord with the present invention:

| | I | II | III | IV | V | VI | VII | VIII |
|---|---|---|---|---|---|---|---|---|
| STPP | — | — | 54.3 | 51.4 | 51.4 | — | — | 50.9 |
| Citrate | 35.0 | 17.0 | — | — | — | 46.1 | 40.2 | — |
| Carbonate | — | 17.5 | 14.0 | 14.0 | 14.0 | — | 8.0 | 32.1 |
| Bicarbonate | — | — | — | — | — | 25.4 | — | — |
| Silicate | 32.0 | 14.8 | 14.8 | 10.0 | 10.0 | 1.0 | 25.0 | 3.1 |
| Metasilicate | — | 2.5 | — | 9.0 | 9.0 | — | — | — |
| PB1 | 1.9 | 9.7 | 7.8 | 7.8 | 7.8 | — | — | — |
| PB4 | 8.6 | — | — | — | — | — | — | — |
| Percarbonate | — | — | — | — | — | 6.7 | 11.8 | 4.8 |
| Nonionic | 1.5 | 2.0 | 1.5 | 1.7 | 1.5 | 2.6 | 1.9 | 5.3 |
| TAED | 5.2 | 2.4 | — | — | — | 2.2 | — | 1.4 |
| HEDP | — | 1.0 | — | — | — | — | — | — |
| DETPMP | — | 0.6 | — | — | — | — | — | — |
| MnTACN | — | — | — | — | — | — | 0.008 | — |
| PMC | — | — | 0.008 | 0.01 | 0.007 | — | — | — |
| BzP | — | — | — | — | 1.4 | — | — | — |
| Paraffin | 0.5 | 0.5 | 0.5 | 0.5 | 0.5 | 0.6 | — | — |
| Acid-thiol ligase | 0.03 | 0.1 | 0.03 | — | — | 0.05 | 0.03 | — |
| Esterification compound | 0.3 | 0.8 | 0.3 | — | — | 0.5 | 0.2 | — |
| Source of energy | 0.3 | 1.0 | 0.2 | — | — | 0.5 | 0.2 | — |
| Desaturase | — | 0.05 | 0.05 | 0.03 | 0.08 | 0.05 | — | — |
| Electron donor system | — | 0.005 | 0.004 | 0.002 | 0.01 | 0.005 | — | — |
| Glutathione transferase | 0.03 | — | 0.03 | — | — | — | — | 0.05 |
| Protease | 0.072 | 0.072 | 0.029 | 0.053 | 0.046 | 0.026 | 0.059 | 0.06 |
| Amylase | 0.012 | 0.012 | 0.006 | 0.012 | 0.013 | 0.009 | 0.017 | 0.03 |
| Lipase | — | 0.001 | — | 0.005 | — | — | — | — |
| BTA | 0.3 | 0.3 | 0.3 | 0.3 | 0.3 | — | 0.3 | 0.3 |
| MA/AA | — | — | — | — | — | — | 4.2 | — |
| 480N | 3.3 | 6.0 | — | — | — | — | — | 0.9 |
| Perfume | 0.2 | 0.2 | 0.2 | 0.2 | 0.2 | 0.2 | 0.1 | 0.1 |
| Sulphate | 7.0 | 20.0 | 5.0 | 2.2 | 0.8 | 12.0 | 4.6 | — |
| pH | 10.8 | 11.0 | 10.8 | 11.3 | 11.3 | 9.6 | 10.8 | 10.9 |
| Miscellaneous and water | | | | Up to 100% | | | | |

EXAMPLE 20

The following granular dishwashing detergent compositions of bulk density 1.02 Kg/L were prepared in accord with the present invention:

| | I | II | III | IV | V | VI | VII | VII |
|---|---|---|---|---|---|---|---|---|
| STPP | 30.0 | 30.0 | 33.0 | 34.2 | 29.6 | 31.1 | 26.6 | 17.6 |
| Carbonate | 30.5 | 30.5 | 31.0 | 30.0 | 23.0 | 39.4 | 4.2 | 45.0 |
| Silicate | 7.4 | 7.4 | 7.5 | 7.2 | 13.3 | 3.4 | 43.7 | 12.4 |
| Metasilicate | — | — | 4.5 | 5.1 | — | — | — | — |
| Percarbonate | — | — | — | — | — | 4.0 | — | — |
| PB1 | 4.4 | 4.2 | 4.5 | 4.5 | — | — | — | — |
| NADCC | — | — | — | — | 2.0 | — | 1.6 | 1.0 |
| Nonionic | 1.2 | 1.0 | 0.7 | 0.8 | 1.9 | 0.7 | 0.6 | 0.3 |
| TAED | 1.0 | — | — | — | — | 0.8- | — | — |
| PAAC | — | 0.004 | 0.004 | 0.004 | — | — | — | — |
| BzP | — | — | — | 1.4 | — | — | — | — |
| Paraffin | 0.2 | 0.3 | 0.2 | 0.3 | — | — | — | — |
| Acid thiol ligase | 0.05 | 0.1 | — | 0.03 | — | 0.05 | 0.01 | — |
| Esterification compound | 0.4 | 1.0 | — | 0.3 | — | 0.5 | 0.09 | — |
| Source of energy | 0.5 | 1.0 | — | 0.3 | — | 0.35 | 0.09 | — |
| Desaturase | — | 0.01 | 0.1 | 0.03 | 0.1 | 0.05 | — | — |
| Electron donor system | — | 0.001 | 0.01 | .0045 | 0.01 | 0.005 | — | — |
| Glutathione transferase | — | — | — | — | — | — | — | 0.005 |
| Protease | 0.036 | 0.015 | 0.03 | 0.028 | — | 0.03 | — | — |
| Amylase | 0.003 | 0.003 | 0.01 | 0.006 | — | 0.01 | — | — |
| Lipase | 0.005 | — | 0.001 | — | — | — | — | — |
| BTA | 0.1 | 0.1 | 0.1 | 0.1 | — | — | — | — |
| Perfume | 0.2 | 0.2 | 0.2 | 0.2 | 0.1 | 0.2 | 0.2 | — |
| Sulphate | 23.4 | 25.0 | 22.0 | 18.5 | 30.1 | 19.3 | 23.1 | 23.6 |
| pH | 10.8 | 10.8 | 11.3 | 11.3 | 10.7 | 11.5 | 12.7 | 10.9 |
| Miscellaneous and water | | | | Up to 100% | | | | |

EXAMPLE 21

The following detergent composition tablets were prepared in accord with the present invention by compression of a granular dishwashing detergent composition at a pressure of 13 KN/cm$^2$ using a standard 12 head rotary press:

| | I | II | III | IV | V | VI |
|---|---|---|---|---|---|---|
| STPP | — | 48.8 | 49.2 | 38.0 | — | 46.8 |
| Citrate | 26.4 | — | — | — | 31.1 | |
| Carbonate | — | 5.0 | 14.0 | 15.4 | 14.4 | 23.0 |
| Silicate | 26.4 | 14.8 | 15.0 | 12.6 | 17.7 | 2.4 |
| Acid-thiol ligase | — | 0.05 | — | 0.01 | 0.1 | — |
| Esterification compound | — | 0.5 | — | 0.08 | 1.0 | — |
| Source of energy | — | 0.5 | — | 0.1 | 0.9 | — |
| Desaturase | — | 0.06 | 0.3 | 0.01 | — | 0.1 |
| Electron donor system | — | 0.005 | 0.04 | 0.01 | — | 0.01 |
| Glutathione transferase | 0.08 | — | — | — | — | — |
| Protease | 0.058 | 0.072 | 0.041 | 0.033 | 0.052 | 0.013 |
| Amylase | 0.01 | 0.03 | 0.012 | 0.007 | 0.016 | 0.002 |
| Lipase | 0.005 | — | — | — | — | — |
| PB1 | 1.6 | 7.7 | 12.2 | 10.6 | 15.7 | — |
| PB4 | 6.9 | — | — | — | — | 14.4 |
| Nonionic | 1.5 | 2.0 | 1.5 | 1.6 | 0.8 | 6.3 |
| PAAC | — | — | 0.02 | 0.009 | — | — |
| MnTACN | — | — | — | — | 0.007 | — |
| TAED | 4.3 | 2.5 | — | — | 1.3 | 1.8 |
| HEDP | 0.7 | — | — | 0.7 | — | 0.4 |
| DETPMP | 0.6 | — | — | — | — | — |
| Paraffin | 0.4 | 0.5 | 0.5 | 0.5 | — | — |
| BTA | 0.2 | 0.3 | 0.3 | 0.3 | — | — |
| PA30 | 3.2 | — | — | — | — | — |
| MA/AA | — | — | — | — | 4.5 | 0.5 |
| Perfume | — | — | 0.05 | 0.05 | 0.2 | 0.2 |

-continued

| | I | II | III | IV | V | VI |
|---|---|---|---|---|---|---|
| Sulphate | 24.0 | 13.0 | 2.3 | — | 10.7 | 3.4 |
| Weight of tablet | 25 g | 25 g | 20 g | 30 g | 18 g | 20 g |
| pH | 10.6 | 10.6 | 10.7 | 10.7 | 10.9 | 11.2 |
| Miscellaneous and water | | | Up to 100% | | | |

EXAMPLE 22

The following liquid dishwashing detergent compositions of density 1.40 Kg/L were prepared in accord with the present invention:

| | I | II | III | IV |
|---|---|---|---|---|
| STPP | 17.5 | 17.5 | 17.2 | 16.0 |
| Carbonate | 2.0 | — | 2.4 | — |
| Silicate | 5.3 | 6.1 | 14.6 | 15.7 |
| NaOCl | 1.1 | 1.1 | 1.1 | 1.2 |
| Polygen/carbopol | 1.1 | 1.0 | 1.1 | 1.2 |
| Nonionic | — | — | 0.1 | — |
| NaBz | 0.7 | 0.8 | — | — |
| Acid-thiol ligase | 0.5 | — | — | 0.05 |
| Esterification compound | 3.5 | — | — | 0.5 |
| Source of energy | 5.0 | — | — | 0.4 |
| Desaturase | 0.05 | — | 0.1 | — |
| Electron donor system | 0.006 | — | 0.01 | — |
| Glutathione transferase | — | 0.05 | — | 0.05 |
| NaOH | — | 1.9 | — | 3.5 |
| KOH | 2.8 | 3.5 | 3.0 | — |
| pH | 11.0 | 11.7 | 1.0.9 | 11.0 |
| Sulphate, miscellaneous and water | | up to 100% | | |

EXAMPLE 23

The following liquid rinse aid compositions were prepared in accord with the present invention:

| | I | II | III | I | II |
|---|---|---|---|---|---|
| Nonionic | 12.0 | — | 14.5 | 12.0 | — |
| Nonionic blend | — | 64.0 | — | — | 64.0 |
| Citric | 3.2 | — | 6.5 | 3.2 | — |
| Acid-thiol ligase | 0.005 | 0.005 | 0.005 | — | 0.005 |
| Esteriflcation compound | 0.05 | 0.04 | 0.05 | — | 0.04 |
| Source of energy | 0.04 | 0.05 | 0.05 | — | 0.05 |
| Desaturase | — | 0.005 | 0.01 | — | — |
| Electron donor system | — | 0.001 | 0.001 | — | — |
| Glutathione transferase | — | — | — | 0.05 | 0.01 |
| HEDP | 0.5 | — | — | 0.5 | — |
| PEG | — | 5.0 | — | — | 5.0 |
| SCS | 4.8 | — | 7.0 | 4.8 | — |
| Ethanol | 6.0 | 8.0 | — | 6.0 | 8.0 |
| pH of the liquid | 2.0 | 7.5 | 1 | 2.0 | 7.5 |

EXAMPLE 24

The following liquid dishwashing compositions were prepared in accord with the present invention:

| | I | II | III | IV | V | VI |
|---|---|---|---|---|---|---|
| Alkyl (1-7) ethoxy sulfate | 28.5 | 27.4 | 19.2 | 34.1 | 34.1 | 28.5 |
| Amine oxide | 2.6 | 5.0 | 2.0 | 3.0 | 3.0 | 2.6 |
| C12 glucose amide | — | — | 6.0 | — | — | — |
| Betaine | 0.9 | — | — | 2.0 | 2.0 | 0.9 |
| Xylene sulfonate | 2.0 | 4.0 | — | 2.0 | — | 2.0 |
| Neodol C11E9 | — | — | 5.0 | — | — | — |
| Polyhydroxy fatty acid amide | — | — | — | 6.5 | 6.5 | — |
| Sodium diethylene penta acetate (40%) | — | — | 0.03 | — | — | — |
| Diethylenetriamine penta acetate | — | — | — | 0.06 | 0.06 | — |
| Sucrose | — | — | — | 1.5 | 1.5 | — |
| Ethanol | 4.0 | 5.5 | 5.5 | 9.1 | 9.1 | 4.0 |
| Alkyl diphenyl oxide disulfonate | — | — | — | — | 2.3 | — |
| Calcium formate | — | — | — | 0.5 | 1.1 | — |
| Ammonium citrate | 0.06 | 0.1 | — | — | — | 0.06 |
| Sodium chloride | — | 1.0 | — | — | — | — |
| Magnesium chloride | 3.3 | — | 0.7 | — | — | 3.3 |
| Calcium chloride | — | — | 0.4 | — | — | — |
| Sodium sulfate | — | — | 0.06 | — | — | — |
| Magnesium sulfate | 0.08 | — | — | — | — | 0.08 |
| Magnesium hydroxide | — | — | — | 2.2 | 2.2 | — |
| Sodium hydroxide | — | — | — | 1.1 | 1.1 | — |
| Hydrogen peroxide | 0.02 | 0.16 | 0.006 | — | — | 0.02 |
| Acid-thiol ligase | 0.05 | 0.5 | 0.1 | — | 0.03 | 0.05 |
| Esterification compound | 0.5 | 2.25 | 1.0 | — | 0.25 | 0.5 |
| Source of energy | 0.5 | 4.0 | 1.0 | — | 0.3 | 0.5 |
| Desaturase | 0.05 | — | 0.1 | 0.5 | 0.05 | 0.05 |
| Electron donor system | 0.005 | — | 0.02 | 0.05 | 0.005 | 0.005 |
| Glutathione transferase | 0.05 | — | — | — | — | 0.08 |
| Protease | 0.017 | 0.005 | .0035 | 0.003 | 0.002 | 0.017 |
| Perfume | 0.18 | 0.09 | 0.09 | 0.2 | 0.2 | 0.18 |
| Water and minors | | | Up to 100% | | | |

EXAMPLE 25

The following liquid hard surface cleaning compositions were prepared in accord with the present invention:

| | I | II | III | IV | V | VI |
|---|---|---|---|---|---|---|
| Acid-thiol ligase | 0.03 | 0.1 | 0.2 | — | — | 0.05 |
| Esterification compound | 0.3 | 1.0 | 1.5 | — | — | 0.5 |
| Source of energy | 0.3 | 0.8 | 2.0 | — | — | 0.5 |
| Desaturase | 0.05 | — | — | 0.5 | — | 0.5 |
| Electron donor system | 0.005 | — | — | 0.075 | — | 0.05 |
| Glutathione transferase | — | 0.1 | — | — | 0.05 | — |
| Amylase | 0.01 | 0.002 | 0.005 | 0.02 | 0.001 | 0.005 |
| Protease | 0.05 | 0.01 | 0.02 | 0.03 | 0.005 | 0.005 |
| EDTA* | — | — | 2.90 | 2.90 | — | — |
| Citrate | — | — | — | — | 2.90 | 2.90 |
| LAS | 1.95 | — | 1.95 | — | 1.95 | — |
| C12 AS | — | 2.20 | — | 2.20 | — | 2.20 |
| NaC12(ethoxy) **sulfate | — | 2.20 | — | 2.20 | — | 2.20 |
| C12 Dimethylamine oxide | — | 0.50 | — | 0.50 | — | 0.50 |
| SCS | 1.30 | — | 1.30 | — | 1.30 | — |
| Hexyl Carbitol** | 6.30 | 6.30 | 6.30 | 6.30 | 6.30 | 6.30 |
| Water | | | Balance to 100% | | | |

*Na4 ethylenediamine diacetic acid
**Diethytene glycol monohexyl ether
***All formulas adjusted to pH 7

EXAMPLE 26

The following spray composition for cleaning of hard surfaces and removing household mildew was prepared in accord with the present invention:

| | I | II | III | IV |
|---|---|---|---|---|
| Acid-thiol ligase | 0.05 | 0.2 | 0.05 | — |
| Esterification compound | 0.5 | 1.8 | 0.5 | — |
| Source of energy | 0.5 | 2.0 | 0.5 | — |
| Desaturase | 0.3 | — | — | — |
| Electron donor system | 0.03 | — | — | — |
| Glutathione transferase | — | — | 0.005 | 0.05 |
| Amylase | 0.01 | 0.01 | 0.01 | 0.01 |
| Protease | 0.01 | 0.01 | 0.01 | 0.01 |
| Sodium octyl sulfate | 2.00 | 2.00 | 2.00 | 2.00 |
| Sodium dodecyl sulfate | 4.00 | 4.00 | 4.00 | 4.00 |
| Sodium hydroxide | 0.80 | 0.80 | 0.80 | 0.80 |
| Silicate (Na) | 0.04 | 0.04 | 0.04 | 0.04 |
| Perfume | 0.35 | 0.35 | 0.35 | 0.35 |
| Water and minors | | Up to 100% | | |

What is claimed is:

1. A detergent composition comprising (A) a surfactant and (B) an enzyme selected from the group consisting of an acid-thiol ligase, desaturase, gluthathione S-transferase and mixtures thereof, wherein said enzyme increases the water-solubility of saturated fatty acid-containing stains/soils.

2. A detergent composition according to claim 1 wherein said enzyme is an acid-thiol ligase, further comprising an esterification compound and a source of energy.

3. A detergent composition according to claim 2 wherein said esterification compound and source of energy are comprised respectively at a level of from about 0.01% to about 10% by weight of total composition.

4. A detergent composition according to claim 3 wherein said esterification compound and source of energy are comprised respectively at a level of from about 0.1% to about 5% by weight of total composition.

5. A detergent composition according to claim 2 wherein said esterification compound is a Coenzyme A.

6. A detergent composition according to claim 2 wherein said source of energy is Adenosine 5'-triphosphate.

7. A detergent composition according to claim 2 wherein said acid-thiol ligase is selected from the group consisting of long-chain-fatty-acid-CoA ligase; acid-CoA ligase, long-chain-fatty-acid-ACP ligase and mixtures thereof.

8. A detergent composition according to claim 1 wherein said enzyme is a desaturase, further comprising an electron donor system.

9. A detergent composition according to claim 8 wherein said electron donor system is comprised at a level of from about 0.001% to about 10%, by weight of total composition.

10. A detergent composition according to claim 9 wherein said electron donor system is comprised at a level of from about 0.01% to about 5%, by weight of total composition.

11. A detergent composition according to claim 8 wherein said electron donor system comprises ferredoxin, NADPH and ferredoxin:NADPH oxido-reductase.

12. A detergent composition according to claim 1 wherein said enzyme is a mixture of acid-thiol ligase and desaturase comprised at a weight ratio of 10:1 to 1:10, pure enzyme by weight.

13. A detergent composition according to claim 12 wherein the acid-thiol ligase and desaturase enzymes are comprised at a weight ratio 1:1 pure enzyme by weight.

14. A detergent composition according to claim 1 wherein said enzyme is a gluthathione S-transferase.

15. A detergent composition according to claim 1 wherein the enzyme increasing the water-solubility of saturated fatty acid-containing stains/soils is present at a level from about 0.0001% to about 2% pure enzyme by weight of the total composition.

16. A detergent composition according to claim 15 wherein the enzyme increasing the water-solubility of saturated fatty acid-containing stains/soils is present at a level from about 0.005% to about 0.5% pure enzyme by weight of the total composition.

17. A detergent composition according to claim 16 wherein the enzyme increasing the water-solubility of saturated fatty acid-containing stains/soils is present at a level from about 0.01% to about 0.1% pure enzyme by weight of the total composition.

18. A detergent composition according to claim 1 further comprising another detergent enzyme providing cleaning performance and/or fabric care benefits.

19. A detergent composition according to claim 18 wherein said another detergent enzyme is a lipolytic enzyme.

20. A detergent composition according to claim 1 further comprising a polymeric soil release agent.

21. A detergent composition according to claim 1 which is in the form of a detergent additive.

22. A fabric softening comprising (A) an enzyme selected from the group consisting of an acid-thiol ligase, desaturase, gluthathione S-transferase an mixtures thereof and (B) a cationic surfactant comprising two long chain lengths having at least 11 alkyl carbons in the chain wherein said enzyme increases the water solubility of fatty acid-containing stains/soils.

23. A method of cleaning comprising the step of contacting the fabric with a detergent composition according to claim 1 for fabric cleaning and/or fabric stain removal and/or fabric whiteness maintenance and/or fabric softening and/or fabric color appearance and/or fabric dye transfer inhibition.

24. A method of cleaning comprising the step of contacting hard surfaces such as floors, walls, bathroom tiles and the like with a detergent composition according to claim 1.

25. A method of cleaning comprising the step of contacting dishware with a detergent composition according to claim 1.

* * * * *

UNITED STATES PATENT AND TRADEMARK OFFICE

CERTIFICATE OF CORRECTION

PATENT NO. : 6,133,227

DATED : October 17, 2000

INVENTOR(S) : Mary Vijayarani Barnabas et al.

It is certified that error appears in the above-identified patent and that said Letters Patent is hereby corrected as shown below:

Column 52, line 34, after "softening" add – composition --.

Column 52, line 36, "an" should read –and--.

Signed and Sealed this

Eighth Day of May, 2001

*Attest:*

Nicholas P. Godici

NICHOLAS P. GODICI

*Attesting Officer*

*Acting Director of the United States Patent and Trademark Office*